US010745173B2

(12) United States Patent
Zhang

(10) Patent No.: US 10,745,173 B2
(45) Date of Patent: Aug. 18, 2020

(54) ASSEMBLED PLASTIC TRAY

(71) Applicant: SICHUAN LI CHUAN PLASTIC PRODUCTS CO., LTD, Chengdu (CN)

(72) Inventor: Hong Zhang, Chengdu (CN)

( * ) Notice: Subject to any disclaimer, the term of this patent is extended or adjusted under 35 U.S.C. 154(b) by 0 days.

(21) Appl. No.: 16/516,725

(22) Filed: Jul. 19, 2019

(65) Prior Publication Data

US 2020/0002053 A1 Jan. 2, 2020

Related U.S. Application Data

(63) Continuation of application No. PCT/CN2018/111702, filed on Oct. 24, 2018.

(51) Int. Cl.
*B65D 19/00* (2006.01)
*B65D 19/18* (2006.01)
*B65D 19/38* (2006.01)

(52) U.S. Cl.
CPC ..... *B65D 19/18* (2013.01); *B65D 19/38* (2013.01); *B65D 2519/00034* (2013.01); *B65D 2519/00069* (2013.01); *B65D 2519/00129* (2013.01); *B65D 2519/00273* (2013.01); *B65D 2519/00432* (2013.01); *B65D 2519/00532* (2013.01); *B65D 2519/00572* (2013.01); *B65D 2519/00796* (2013.01)

(58) Field of Classification Search
CPC ..... B65D 19/18; B65D 19/38; B65D 2519/00432; B65D 2519/00447; B65D 2519/00452; B65D 2519/00572
USPC ..... 108/57.25
See application file for complete search history.

(56) References Cited

U.S. PATENT DOCUMENTS 3,428,002 A * 2/1969 McIntire, Jr. ..... B65D 19/0002 248/346.02
3,880,092 A * 4/1975 Seeber ..... B65D 19/0016 108/57.28
4,227,467 A 10/1980 Kindsfather
(Continued)

FOREIGN PATENT DOCUMENTS

CN 107399490 A 11/2017
CN 108639501 A 10/2018
(Continued)

*Primary Examiner* — Matthew W Ing
(74) *Attorney, Agent, or Firm* — Erson IP (Nelson IP)

(57) ABSTRACT

Disclosure is an assembled plastic tray. The plastic tray includes a mainboard and strakes fixed at two sides of the mainboard. The mainboard includes two rib frames and multiple strip-shaped pad feel uniformly distributed between the two rib frames. The steps for assembling the plastic tray includes: respectively inserting first mainboard steel tubes and second mainboard steel tubes into first mainboard steel tube holes and second mainboard steel tube holes of the rib frames on the mainboard, subsequently, mounting the two strakes on the two side surfaces of the mainboard through a boss and penetrating slots and fixing the boss and the penetrating slots through strake connection blocks, then inserting strake steel tubes into strake steel tube holes on the two strakes, and then, fixing the strake steel tubes and the first mainboard steel tubes through steel tube connection members and steel blocks.

8 Claims, 25 Drawing Sheets

(56) References Cited

U.S. PATENT DOCUMENTS

| | | | | | |
|---|---|---|---|---|---|
| 4,316,419 | A * | 2/1982 | Cupido | B65D 19/0012 | 108/56.1 |
| 4,735,154 | A * | 4/1988 | Hemery | B65D 19/0012 | 108/56.1 |
| 5,868,080 | A * | 2/1999 | Wyler | B65D 19/0022 | 108/57.25 |
| 6,125,770 | A * | 10/2000 | Brandenburg | B65D 19/0063 | 108/57.25 |
| 6,167,817 | B1 * | 1/2001 | Liu | B65D 19/0012 | 108/51.11 |
| 6,705,237 | B2 * | 3/2004 | Moore, Jr. | B65D 19/0012 | 108/57.25 |
| 6,748,876 | B2 * | 6/2004 | Preisler | B65D 19/0012 | 108/51.3 |
| 8,448,583 | B2 | 5/2013 | Apps et al. | | |
| 2011/0078095 | A1 | 3/2011 | Eckhardt | | |
| 2014/0251190 | A1 * | 9/2014 | Kessler | B65D 19/38 | 108/57.25 |
| 2018/0339802 | A1 * | 11/2018 | Lenz | B65D 11/26 | |

FOREIGN PATENT DOCUMENTS

| | | | |
|---|---|---|---|
| CN | 108639502 | A | 10/2018 |
| CN | 108674779 | A | 10/2018 |
| JP | 2001233337 | A | 8/2001 |
| JP | 2010241444 | A | 10/2010 |
| KR | 101494235 | B1 * | 2/2015 |

* cited by examiner

ASSEMBLED PLASTIC TRAY

CROSS-REFERENCE TO RELATED APPLICATIONS

This application is a continuation of International Patent Application No. PCT/CN2018/111702 with a filing date of Oct. 24, 2018, designating the United States, now pending, and further claims priority to Chinese Patent Application No. 201810610004.X with a filing date of Jun. 13, 2018, Chinese Patent Application No. 201820916470.6 with a filing date of Jun. 13, 2018, Chinese Patent Application No. 201810609363.3 with a filing date of Jun. 13, 2018, Chinese Patent Application No. 201820916491.8 with a filing date of Jun. 13, 2018, Chinese Patent Application No. 201810609355.9 with a filing date of Jun. 13, 2018, and Chinese Patent Application No. 201820916498.X with a filing date of Jun. 13, 2018. The content of the aforementioned applications, including any intervening amendments thereto, are incorporated herein by reference.

TECHNICAL FIELD

The disclosure relates to the technical field of tray products, and particularly relates to an assembled plastic tray.

BACKGROUND OF THE PRESENT INVENTION

At present, since the most plastic trays are formed by adopting integrated injection molding, the whole tray is an entirety that cannot be separated. This facilitates the stabilization of the product, but there are defects in the process of actual use, namely, when an operator manipulates a forklift and when the plug board of the fork lift is inserted into the tray, the side surfaces of the tray are often collided and damaged because of incorrect alignment. Since the whole tray is an entirety, when the side surfaces of the tray are damaged and cannot continue to be used, there is a need for changing the whole tray. However, damaged positions are only side surfaces, and a middle region is still intact, so the entire change can result in great waste, which can bring huge use cost for storage enterprises. According to recent statistics, the service life of a plastic tray is often three years. For large-scale storage enterprises, because the quantity of the used tray s is usually more than 10,000 pieces, change of the tray will spend great cost.

Thus, it is urgent to need a tray which can be combined with strakes in different sizes, thereby reducing the manufacturing cost of a mould and saving raw materials; also, after the tray of the forklift is damaged, there is no need for changing the whole tray, namely, it is only needed to change the strake.

SUMMARY OF PRESENT INVENTION

In order to solve the problem existing in the prior art, the disclosure provides an assembled plastic tray, which has the advantages of low cost, simple mounting, rapid strake change and the like.

The technical solution adopted by the disclosure is as follows:

An assembled plastic tray, comprising: a mainboard and strakes fixed at two sides of the mainboard, the mainboard comprising two rib frames and a plurality of strip-shaped pad feet fixedly connected under the rib frames, and also comprising first mainboard steel tubes, second mainboard steel tubes, strake steel tubes, steel tube connection members and steel tube blocks; wherein, the strip-shaped pad feet, along the length directions, are all provided with second man board steel tube holes for mounting the second mainboard steel tubes, the two ends of the second mainboard steel tube extend out of the second mainboard steel tube hole, the second mainboard steel tube hole of the strake corresponding to the strip-shaped pad foot is provided with a placement groove, and the second steel tube hole is disposed far away from the rib frame; and opposite side surfaces of the rib frame are both provided with penetrating slots;

two ends and a middle portion of the other opposite two side surfaces of the rib frame are each at least provided with one first mainboard steel tube hole for mounting the first mainboard steel tube, the first mainboard steel tube hole and the second mainboard steel tube hole are vertical and penetrate through the rib frame;

the strake, along the length direction, is provided with a strake steel tube hole for mounting a strake steel tube, the strake steel tube hole penetrates through the opposite side surfaces of the strake, the side surface of the strake opposite to the rib frame is provided with a boss matched with the penetrating slot, and the boss is inserted into the corresponding penetrating slot to connect the mainboard with the strake through a strake connection block;

two ends of the first mainboard steel tube located at the two ends of the rib frame and two ends of the strake steel tube are all connected through steel tube connection members, the outer side of the steel tube connection member is provided with a steel tube block for connecting the steel tube connection member with the mainboard and the strake.

In the above structure, the steps for assembling the plastic tray comprise: firstly, respectively inserting first mainboard steel tubes and second mainboard steel tubes into first mainboard steel tube holes and second mainboard steel tube holes of the rib frame on the mainboard, subsequently, mounting the two strakes on the two side surfaces of the mainboard through the boss and the penetrating slots and fixing the boss and the penetrating slots through strake connection blocks, then inserting strake steel tubes into strake steel tube holes on the two strakes, and finally, fixing the strake steel tubes and the first mainboard steel tubes through the steel tube connection members and steel blocks.

Preferably, the number of the two rib frames is 2, and the strip-shaped pad feet are disposed between the two rib frames. Arrangement of the two rib frames facilitates double-face use of this plastic tray.

Preferably, the side surface of the rib frame opposite to the first mainboard steel tube hole is provided with a second penetrating slot, the second penetrating slot is internally provided with a bumper block having a shape matched with the shape of the second penetrating slot, and the second penetrating slot is connected with the bumper block through the strake connection block.

Arrangement of the bumper block is to prevent the second penetrating slot from being damaged in the process of use.

Preferably, the outer side of the strake is also provided with a connection bolt, and the connection bolt passes through the outer wall of the strake to be connected with the mainboard. The strake is connected with the mainboard through the connection blot, which improves the connection reliability of the strake.

Preferably, the strake connection block comprises a clamp portion as well as a first elastic button and a second elastic button symmetrically formed at the lower end of the clamp portion, and a first clamp convex and a second clamp convex are respectively formed in the outer sides of the first elastic button and the second elastic button.

Preferably, the two side surfaces of the mainboard opposite to the strake are both provided with positioning grooves, and the strake is provided with a lug matched with the positioning groove.

Preferably, the steel tube connection member is of a "concave" shape, and the two sides of the steel tube connection member are respectively connected with the strake steel tube and the first mainboard steel tube in an insertion manner; the steel tube block comprises a block body and a plurality of block connection members disposed on one side surface of the block body, the block connection member comprises a third elastic button and a fourth elastic button which are symmetrically disposed, and a third clamp convex and a fourth clamp convex are respectively formed in the outer sides of the third elastic button and the fourth elastic button; the block connection member passes through the bottom of the steel tube connection member to be respectively connected with the strake and the mainboard in an insertion manner.

Preferably, the materials of the mainboard and the strake are both PP plastic or PE.

The disclosure has the beneficial effects that:

(1) firstly, on the mainboard, the first mainboard steel tubes and the second mainboard steel tubes are respectively inserted into the first mainboard steel tube holes and the second mainboard steel tube holes, subsequently, the two strakes are mounted on the two side surfaces of the mainboard through the bosses and the penetrating slots, and the boss and the penetrating slot are fixed through the strake connecting block, then the strake steel tubes are inserted into the strake steel tube holes on the two strakes, and the strake steel tube and the first mainboard steel tube are fixed through the steel tube connection member and the steel tube block, and finally, the lop and bottom anti-skid pads are mounted on the rib frame, and the strake and the rib frame are fixed in a clamping manner; and the fixation of the strake steel tube and the rib frame is more firm through double fixation, and widened strakes are convenient to change, while costs are saved;

(2) arrangement of the two rib frames facilitates double-face use of this plastic tray;

(3) arrangement of the bumper block is to prevent the second penetrating slot from being damaged in the process of use;

(4) the strake is connected with the mainboard through the connection blot, which improves the connection reliability of the strake;

(5) the strake connection block includes the clamp portion as well as the first elastic button and the second elastic button symmetrically formed at the lower end of the clamp portion, which is to facilitate installation, and when the strake connection block connects the strake with the rib frame, the strake and the rib frame are tightly clamped through the first clamp convex and the second clamp convex so that the structure is more stable;

(6) the positioning groove is disposed in the strip-shaped pad feet, and the strake is provided with the lug matched with the positioning groove, which is to facilitate positioning and meanwhile take an effect of limiting the strake, so that connection between the strake and the mainboard is more stable;

(7) when in connection, two sides of the steel tube connection member are respectively connected with the first mainboard steel tube and the strake steel tube in the insertion manner, the block connection member disposed on the steel tube block passes through the steel tube connection member to be connected with the rib frame and the strake, so that connection is convenient, and the structure is firm when in use;

(8) the materials of the mainboard, the widened strake and steel tube block are all PP plastic or PE plastic; the material of the steel tube connection member is iron; the mainboard steel tube and the strake steel tube are both formed by cutting a profile steel tube; the mainboard, the widened strake and the steel tube block all adopt PP plastic or PE plastic, which is because the PP plastic or PE plastic has the advantages of light weight, tasteless and no toxicity, acid alkali resistance and good chemical stability, the material of the steel tube connection member is iron, which is because iron has high hardness and is not easy to deform; the mainboard steel tube and the strake steel tube are both formed by cutting the profile steel tube, so cost is low, and processing is convenient;

(9) the double-layer rib frame structure is higher in design strength, and meanwhile the penetrating slot of connecting the rib frame with the strake and the boss are both disposed on the double-layer rib frame, and therefore connection is more tight, thereby further promoting the service life of the tray.

Figure 1:
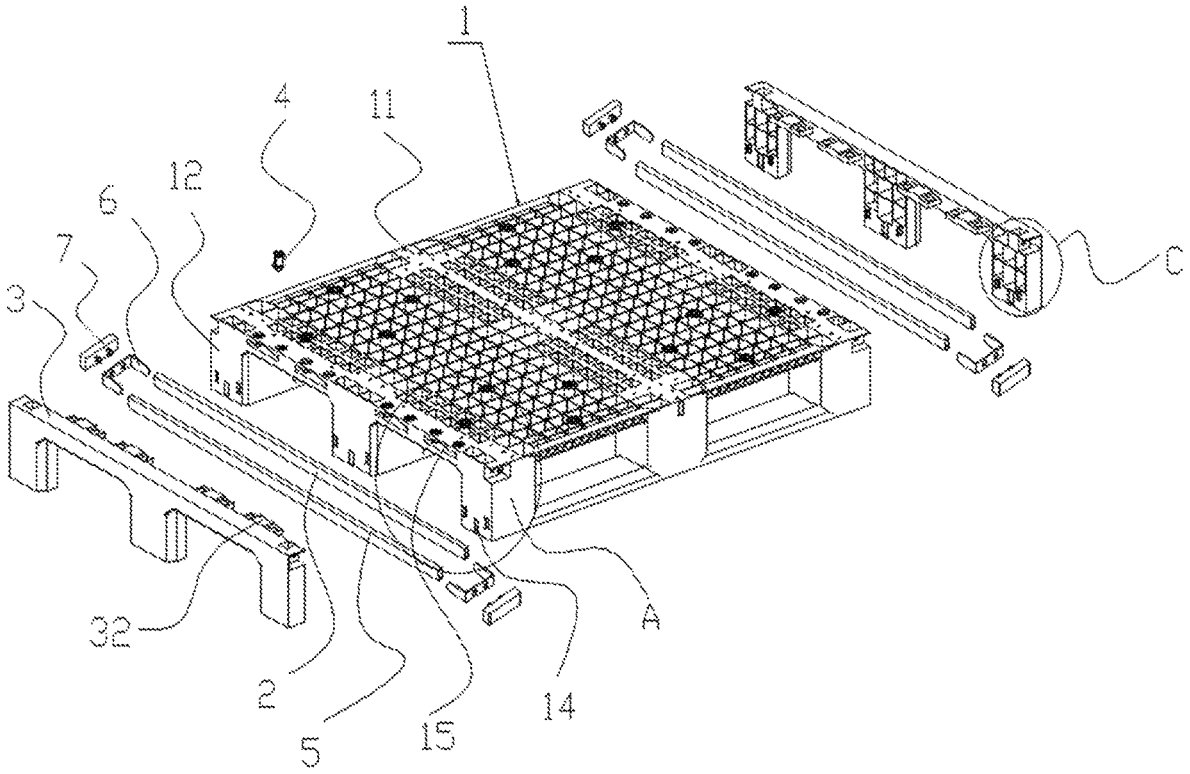
FIG. 1 is a splitting diagram of an overall structure according to Embodiment 1-Embodiment 5 of the disclosure.

Reference numbers are as follows:

Reference numbers of Embodiment 6-Embodiment 10:

1, mainboard; 11, rib frame; 12, strip-shaped pad foot; 13, first mainboard steel tube hole; 14, second mainboard steel tube hole; 15, penetrating slot; 16, positioning groove; 2, first mainboard steel tube; 3, strake; 31, strake steel tube hole; 32, boss; 33, placement groove; 34, lug; 4, strake connection block; 41, clamp portion; 42, first elastic button; 43, second elastic button, 44, first clamp convex; 45, second clamp convex; 5, strake steel tube; 6, steel tube connection member; 7, steel tube block; 71, block body; 72, block connection member; 721, third elastic button; 722, fourth elastic button; 723, third clamp convex; 724, fourth clamp convex; 8, second mainboard steel tube.

Reference numbers of Embodiment 1-Embodiment 5:

1, mainboard; 11, rib frame; 12, strip-shaped pad foot; 13, first mainboard steel tube hole; 14, second mainboard steel tube hole; 15, penetrating slot; 16, positioning groove; 2, first mainboard steel tube; 3, strake; 31, strake steel tube hole; 32, boss; 33, placement groove; 34, lug; 4, strake connection block; 41, clamp portion; 42, first elastic button; 43, second elastic button; 44, first clamp convex; 45, second clamp convex; 5, strake steel tube; 6, steel tube connection member; 7, steel tube block; 71, block body; 72, block connection member; 721, third elastic button; 722, fourth elastic button; 723, third clamp convex; 724, fourth clamp convex; 8, second mainboard steel tube.

Reference numbers of Embodiment 11-Embodiment 15:

1, mainboard; 11, rib frame; 12, strip-shaped pad foot; 13, first mainboard steel tube hole; 14, second mainboard steel tube hole; 15, penetrating slot; 16, positioning groove; 2, first mainboard steel tube; 3, strake; 31, strake steel tube hole; 32, boss; 33, placement groove; 34, lug; 4, strake connection block; 41, clamp portion; 42, first elastic button; 43, second elastic button; 44, first clamp convex; 45, second clamp convex; 5, strake steel tube; 6, steel tube connection member; 7, steel tube block; 71, block body; 72, block connection member; 721, third elastic button; 722, fourth elastic button; 723, third clamp convex; 724, fourth clamp convex; 8, second mainboard steel tube; 9, bumper block; 10, connection bolt

DETAILED DESCRIPTION OF PREFERRED EMBODIMENTS

Embodiments of the disclosure will be described in detail in conjunction with drawings.

Embodiment 1

As shown in FIGS. 1-9, an assembled plastic tray shaped like a Chinese word includes a mainboard 1 and strakes 3 fixed at two sides of the mainboard 1, the mainboard 1 includes rib frames 11 and a plurality of strip-shaped pad feet 12 uniformly distributed under the rib frames 11, and also includes first mainboard steel tubes 2, second mainboard steel tubes 8, strake steel tubes 31, steel tube connection members 6 and steel tube blocks 7;

the strip-shaped pad feet 12, along the length direction, are all provided with second man board steel tube holes 14 for mounting the second mainboard steel tubes 8, the two ends of the second mainboard steel tube 8 extend out of the second mainboard steel tube hole 14, the second mainboard steel tube hole 14 of the strake 3 corresponding to the strip-shaped pad foot 12 is provided with a placement groove 33;

opposite two side surfaces of the rib frame 11 are provided with a plurality of first mainboard steel tube holes 13 for mounting the first mainboard steel tubes 2, two ends and a middle portion of the rib frame 11 are each at least provided with one first mainboard steel tube hole 13, the first mainboard steel tube hole 13 and the second mainboard steel tube hole 14 are vertical and penetrate through the rib frame 11 and the other opposite two surfaces of the rib frame 11 are both provided with penetrating slots 15;

the strake 3, along the length direction, is provided with a strake steel tube hole 31 for mounting a strake steel tube 31, the strake steel tube hole 31 penetrates through the opposite side surfaces of the strake 3, the side surface of the strake 3 opposite to the rib frame 11 is provided with a boss 32 matched with the penetrating slot 15, and the boss 32 is inserted into the corresponding penetrating slot 15 to connect the mainboard 1 with the strake 3 through, a strake connection block 4;

two ends of the first mainboard steel tube 2 located at the two ends of the rib frame 11 and two ends of the strake steel tube 5 are all connected through steel tube connection members 6, the outer side of the steel tube connection member 6 is provided with a steel tube block 7 for connecting the steel tube connection member is with the rib frame 11 and the strake 3.

When in use, a plurality of second mainboard steel tubes 8 are inserted into the second mainboard steel tube holes 14 on the strip-shaped pad feet 12 in advance, the bosses 32 on the strakes 3 are mutually connected with the penetrating slots 15 on the rib frames 11 in an insertion manner and then fixed through the strake connection blocks 4 after insertion, after that, the first mainboard steel tubes 2 are inserted into the first mainboard steel tube holes 13 on the rib frames 11, and the strake steel tubes 5 are inserted into the strake steel tubes 31 of the strakes 3; the first mainboard steel tubes 2 located at two ends of the rib frame 11 are connected with the strake 3 connection steel tubes on the strakes 3 through the strake 3 connection member, then the steel tube connection member 6 is fixed together with the mainboard 1 and the strake 3 through the steel tube block 7 disposed on the outer side of the steel tube connection member 6, and here a clamping manner is adopted for fixation in order to facilitate change of the strake 3; fixation is more firm through double fixation, the change of the strake 3 is convenient, and meanwhile the cost is saved; the injection molding process of the mainboard 1 and the widened strake 3 includes the following steps: (1) loading, namely, mixing selected materials in is proportion and putting the mixture into an injection molding machine; (2) drying the materials, namely, evaporating the moisture contained in the materials; (3) checking and testing a device, namely, detecting if there is any abnormality in the device; (4) changing a mould, namely, changing the corresponding mould to prepare for injection molding; (5) performing screw heating to melt the materials in the injection molding machine; (6) closing the mould, namely, closing upper and lower moulds; (7) performing injection molding, namely, inject melted materials into the moulds; (8) opening the moulds, namely, opening the moulds after the products subjected to injection molding are cooled; (9) finishing, namely, taking out the cooled products and finishing to remove burr edges; (10) performing quality inspection, namely, performing quality inspection on the corresponding products, to remove defective products; and (11) packaging, namely, independently packaging individual products, and after that, binning and pasting qualified certifications.

Embodiment 2

Figure 6:
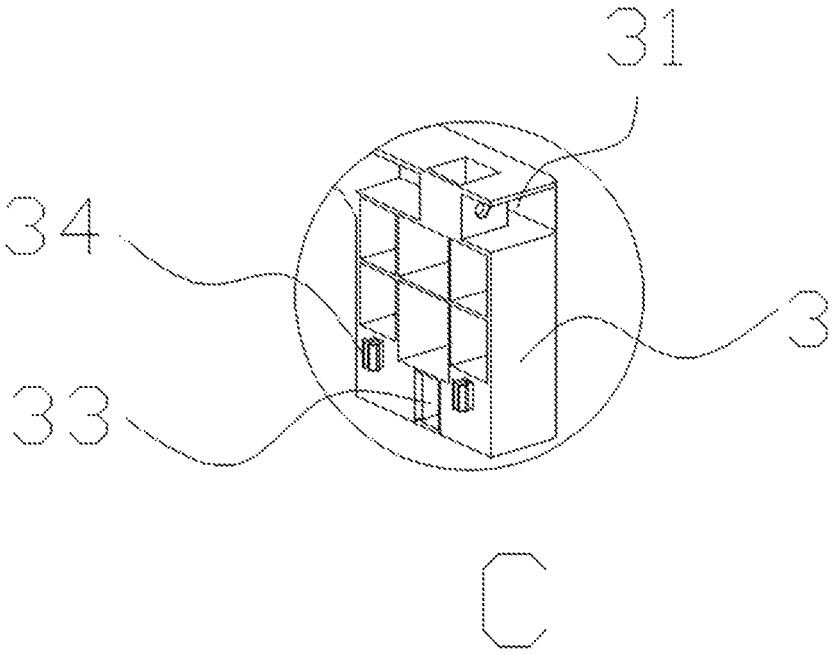
FIG. 6 is a partially enlarged diagram of a structure at position C according to Embodiment 1-Embodiment 5 of the disclosure.
Figure 7:
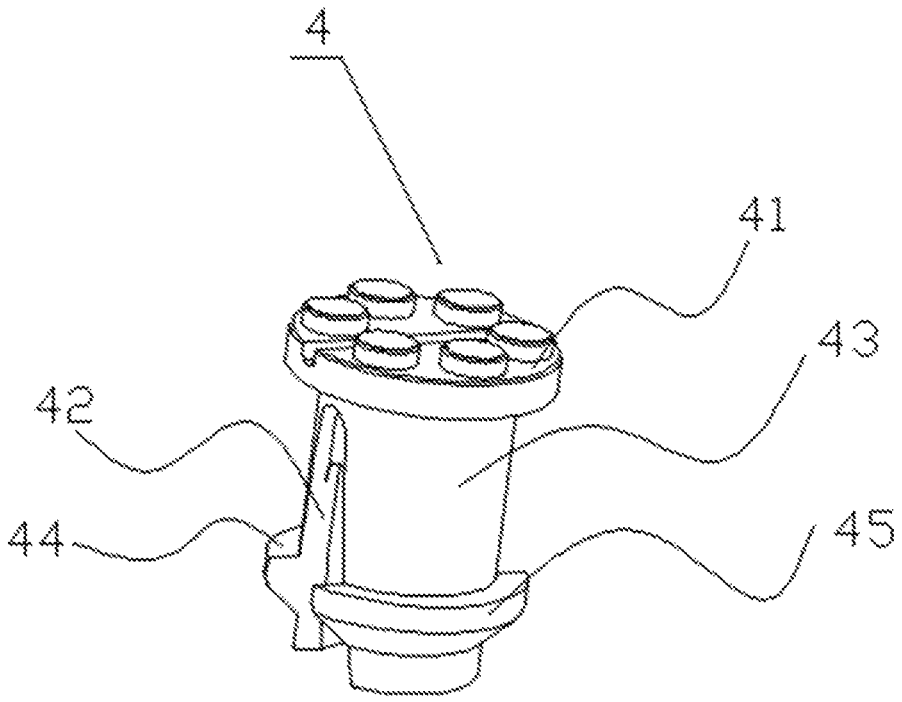
FIG. 7 is a diagram of an overall structure of a strake connection block according to Embodiment 1-Embodiment 5 of the disclosure.
Figure 8:
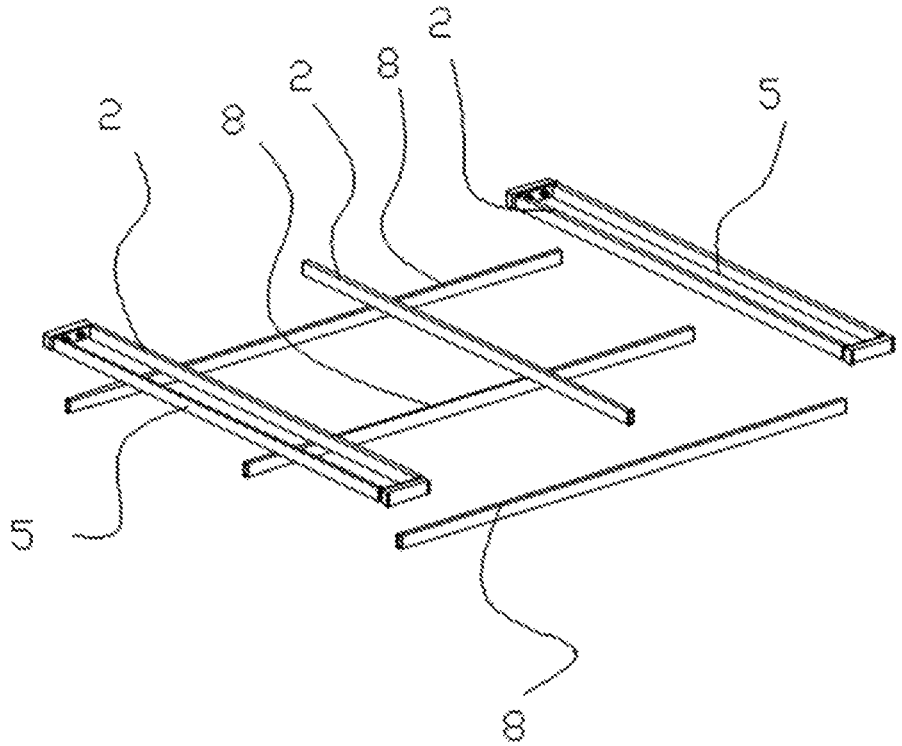
FIG. 8 is a structural diagram of steel tube distribution according to Embodiment 1-Embodiment 5 of the disclosure.
Figure 9:
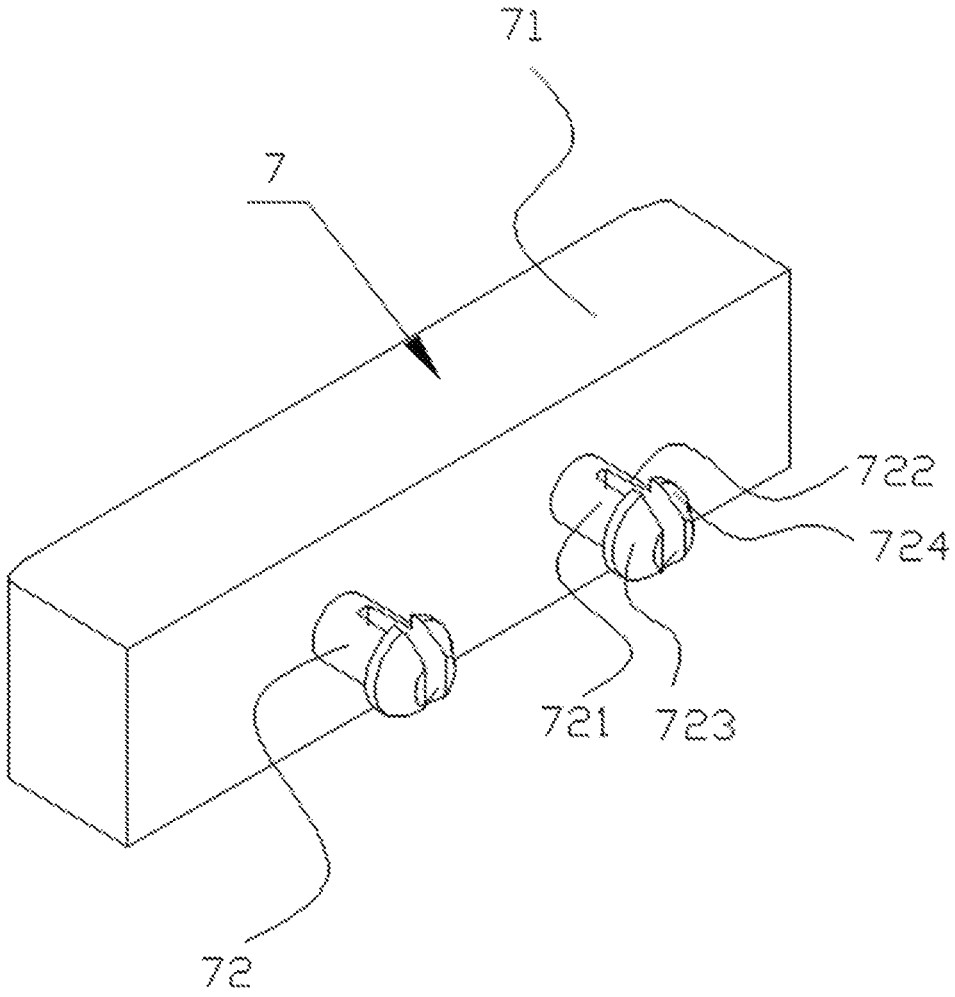
FIG. 9 is a diagram of an overall structure of a steel tube block according to Embodiment 1-Embodiment 5 of the disclosure.

As shown in FIG. 6, this embodiment is based on Embodiment 1. The shake connection block 4 includes a clamp portion 41 as well as a first elastic button 42 and a second clamp portion symmetrically formed at the lower end of the clamp portion 41, and a first clamp convex 44 and a second clamp convex 45 are respectively formed in the outer sides of the first elastic button 42 and the second elastic button 43.

The strake connection block 4 includes the clamp portion 41 as well as the first elastic button 42 and the second clamp portion symmetrically formed at the lower end of the clamp portion 41, which is to facilitate installation, and when this strake connection block 4 connects the strake 3 with the rib frame 11, the strake and the rib frame are tightly clamped through the first clamp convex 44 and the second clamp convex 45 so that the structure is more firm, the upper end surface of the clamp portion 41 is also provided with a line-shaped opening which is parallel to the first elastic button 42 and the second elastic button 43; when in disassembling, the clamp portion 41 is broken through the line-shaped opening by virtue of a tool so as to separate the mainboard 1 from the strake 3.

Embodiment 3

As shown in FIGS. 1-6, this embodiment is based on Embodiment 1. Opposite two side surfaces of the strip-shaped pad foot are also provided with positioning grooves 16, the positioning groove 16 and the second mainboard steel tube hole 14 are in the same plane, and the strake 3 is provided with a lug 34 matched with the positioning groove 16.

The strip-shaped pad foot 12 is provided with the positioning groove 16, and the strake 3 is provided with the lug 54 corresponding to the positioning groove 16, which is to facilitate positioning, and meanwhile take an effect of limiting the strake 3 so that connection between the strake 3 and the mainboard 1 is more stable.

Embodiment 4

As shown in FIGS. 1-9, this embodiment is bused on Embodiment 1. The cross section of the steel tube connection member 6 is of a "concave" shape, and two sides of the steel tube connection member 6 are respectively connected with the strake steel tube 5 and the first mainboard steel tube 2 in an insertion manner; the steel tube block 7 includes a block body 71 and a plurality of block connection members 72 disposed on one side surface of the block body 71, the block connection member 72 includes a third elastic button 721 and a fourth elastic button 722 which are symmetrically disposed, and a third clamp convex and a fourth clamp convex are respectively formed in the outer sides of the third elastic button 721 and the fourth elastic button 722; the block connection member 72 penetrates through the bottom of the steel tube connection member 6 to be respectively connected with the strake 3 and the mainboard 1 in an insertion manner.

When in connection, two sides of the steel tube connection member 6 are respectively connected with the first mainboard steel tube 2 and the strake steel tube 5 in an insertion manner, the block connection member 72 disposed on the steel tube block 7 passes through the steel tube connection member 6 to be connected with the rib frame 11 and the strake 3, so that connection is convenient and the structure is firm when in use.

Embodiment 5

Figure 2:
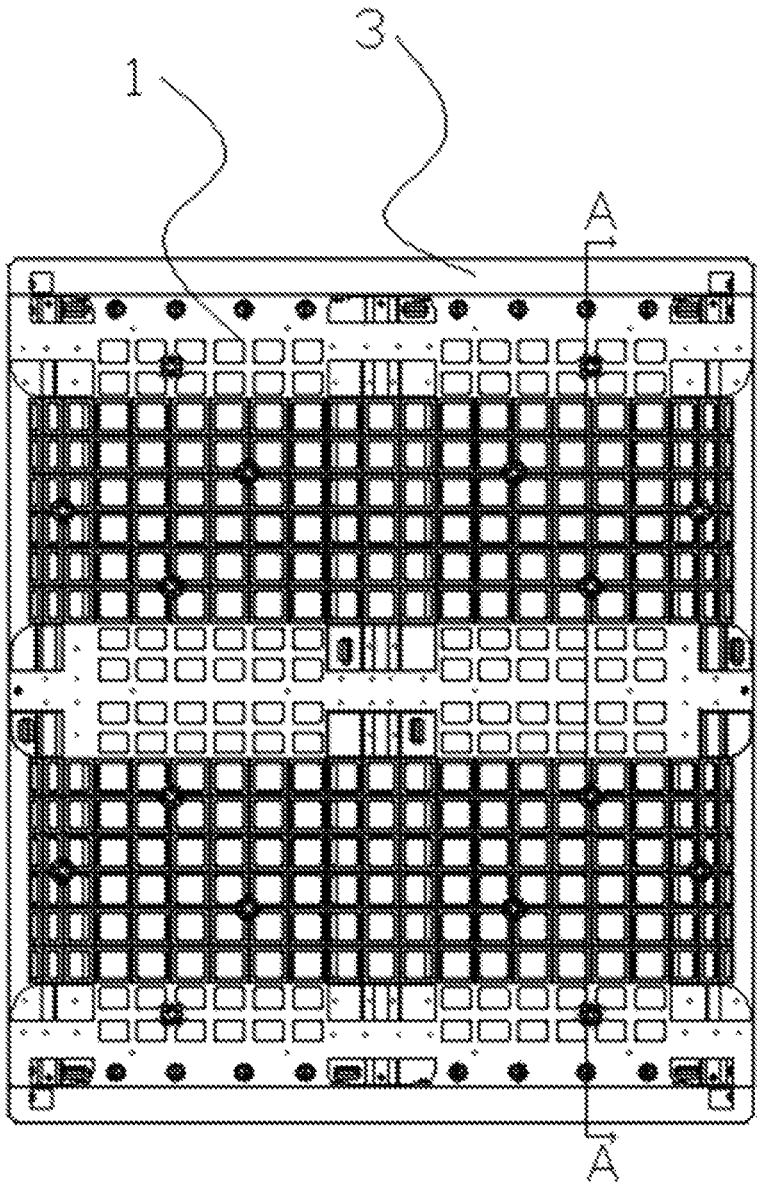
FIG. 2 is a top view of an overall structure according to Embodiment 1-Embodiment 5 of the disclosure.
Figure 3:
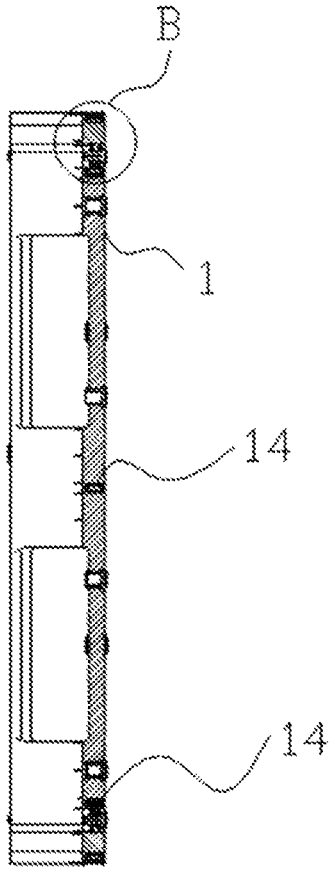
FIG. 3 is a cross-sectional view of an overall structure from a plan view taken along A-A according to Embodiment 1-Embodiment 5 of the disclosure.
Figure 4:
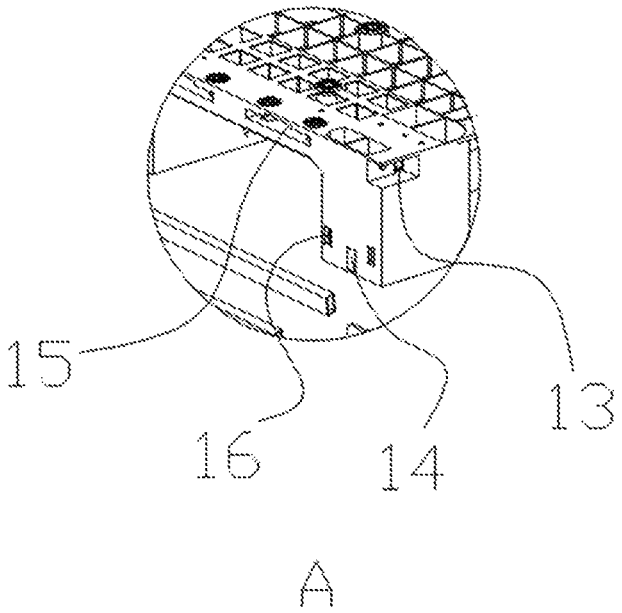
FIG. 4 is a partially enlarged diagram of a structure at position A according to Embodiment 1-Embodiment 5 of the disclosure.
Figure 5:
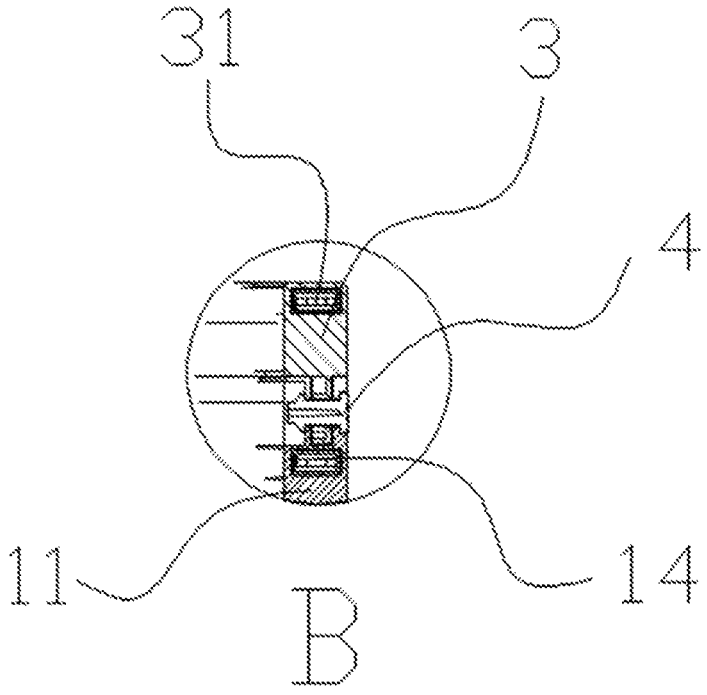
FIG. 5 is a partially enlarged diagram of a structure at position B according to Embodiment 1-Embodiment 5 of the disclosure.

As shown in FIGS. 1-3, this embodiment is based on Embodiment 1. The materials of the mainboard 1, the widened strake 3 and steel tube block 7 are all PP plastic or PE plastic; the material of the steel tube connection member 6 is iron; the mainboard 1 steel tube and the strake steel tube 5 are both formed by cutting a profile steel tube.

The mainboard 1, the widened strike 3 and the steel tube block 7 all adopt PP plastic or PE plastic, which is because the PP plastic or PE plastic has the advantages of light weight, tasteless and no toxicity, acid alkali resistance and good chemical stability, the material of the steel tube connection member 6 is iron, which is because iron has high hardness and is not easy to deform; the mainboard 1 steel tube and the strake steel tube 5 are both formed by cutting the profile steel tube, so cost is low, and processing is convenient.

Embodiment 6

As shown in FIGS. 10-19, an assembled plastic tray having a loop structure with four sides includes a mainboard 1 and strakes 3 fixed at two sides of the mainboard 1, the mainboard 1 includes two rib frames 11 and a plurality of strip-shaped pad feet 12 uniformly distributed under the two rib frames 11, and also includes first mainboard steel tubes 2, second mainboard steel tubes 8, strake steel tubes 5, steel tube connection members 6 and steel tube blocks 7;

The front and rear side surfaces of the rib frame 11 are provided with second mainboard steel tube holes 14 for mounting the second main steel tubes 8, the two ends of the second mainboard steel tube 8 extend out of the rib frame 11, the strake 3 is provided with a placement groove corresponding to the second mainboard steel tube hole 14, and the front and rear side surfaces of the rib frame 11 are both provided with penetrating slots 15;

The left and right side surfaces and the middle portion of the rib frame 11 are each at least provided with a first mainboard steel tube hole 13 for mounting the first mainboard steel tube 2, and the first mainboard steel tube hole 13 and the second mainboard steel tube hole 14 are vertical and respectively penetrate through the two rib frames 11;

the strake 3, along the length direction, is provided with a strake steel tube hole 31 for mounting a strake steel tube 5, the strake steel tube hole 31 penetrates through the opposite side surfaces of the strake 3, the side surface of the strake 3 opposite to the rib frame 11 is provided with a boss 32 matched with the penetrating slot 15, and the boss 32 is inserted into the corresponding penetrating slot 15 to connect the mainboard 1 with the strake 3 through a strake connection block 4;

two ends of the first mainboard steel tube 2 located at the two ends of the rib frame 11 and two ends of the strake steel tube 5 are all connected through the steel tube connection members 6, the outer side of the steel tube connection member 6 is provided with a steel tube block 7 for connecting the steel tube connection member 6 with the rib frame 11 and the strake 3.

In the above structure, the steps for assembling the plastic tray comprise: firstly, respectively inserting first mainboard steel tubes 2 and second mainboard steel tubes 8 into first mainboard steel tube holes 13 and second mainboard steel tube holes 14 of the rib frames 11 on the mainboard 1, subsequently, mounting the two strakes 3 on the two side surfaces of the mainboard 1 through bosses 32 and penetrating slots 15 and fixing the bosses 32 and the penetrating slots 15 through strake connection blocks 4, then inserting strake steel tubes 5 into strake steel tube holes 31 on the two strakes 3, fixing the strake steel tubes 5 and the first mainboard steel tubes 2 through the steel tube connection members 6 and steel blocks 7, and finally, mounting top and bottom non-slip mats on the rib frames 11, wherein, the non-slip mats are mounted on the two rib frames 11 and extend out of the surfaces of the upper and lower rib fames 11 to take an antiskid effect, and the strake 3 and the rib frame 11 are fixed in a clamp manner; fixation is more firm through double fixation, and change of the strake 3 is convenient, and meanwhile cost is saved; the injection molding process of the mainboard 1 and the strake 3 comprise the following step: (1) loading, namely mixing selected materials in a proportion and putting the mixture into an injection molding machine; (2) drying the materials, namely, evaporating the moisture contained in the materials; (3) checking and testing a device, namely, detecting if there is any abnormality in the device; (4) changing a mould, namely, changing the corresponding mould to prepare for injection molding; (5) performing screw healing to melt the materials in the injection molding machine; (6) closing the mould, namely, closing upper and lower moulds; (7) performing injection molding, namely, injecting melted materials into the moulds; (8) opening the moulds, namely, opening the moulds after the products subjected to injection molding are cooled; (9) finishing, namely, taking out the cooled products and finishing to remove bun edges; (10) performing quality inspection, namely, performing quality inspection on the corresponding products to remove defective products; and (11) packaging, namely, independently packaging individual products, and after that, binning and pasting qualified certifications.

Embodiment 7

Figure 17:
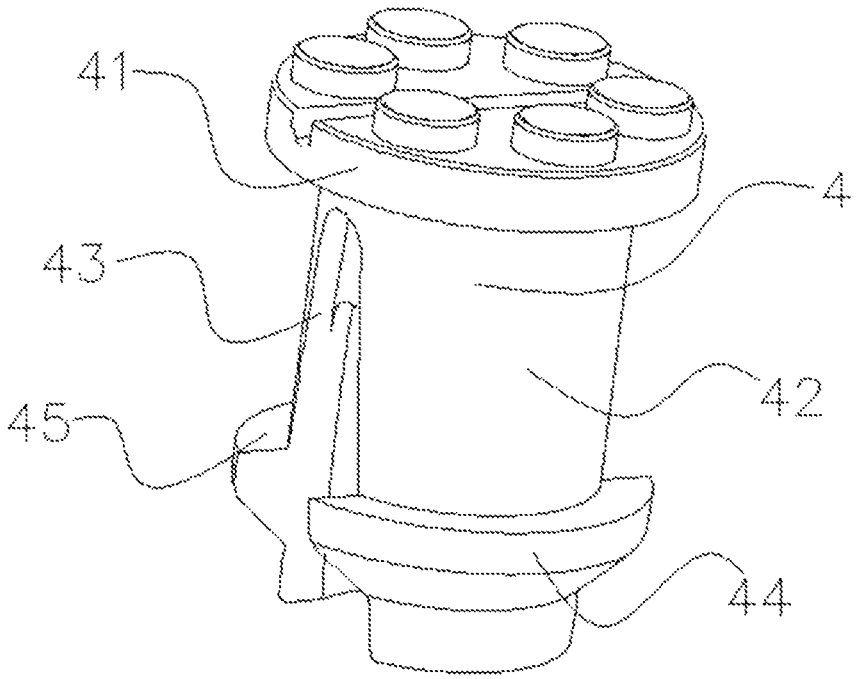
FIG. 17 is a structural diagram of an overall structure of a strake connection block according to Embodiment 6-Embodiment 10 of the disclosure.

As shown in FIG. 17, this embodiment is based on Embodiment 1. The strake connection block 4 includes a clamp portion 41 as well as a first elastic button 42 and a second clamp portion symmetrically formed at the lower end of the clamp portion 41, and a first clamp convex 42 and a second clamp convex 43 are respectively formed in the outer sides of the first elastic button 41 and the second elastic button 43.

The strake connection block 4 includes a clamp portion 41 as well as a first elastic button 42 and a second elastic button 43 symmetrically formed at the lower end of the clamp portion 41, which is to facilitate installation, and when the strake connection block 4 connects the strake 3 with the rib frame 11, the strake 3 and the rib frame 11 are tightly clamped through the first clamp convex 44 and the second clamp convex 45 so that the structure is more stable, the upper end surface of the clamp portion 41 is also provided with a line-shaped opening which is parallel to the first elastic button 42 and the second elastic button 43; when in disassembling, the clamp portion 41 is broken through the line-shaped opening by virtue of a tool so as to separate the mainboard 1 from the strake 3.

Embodiment 8

Figure 15:
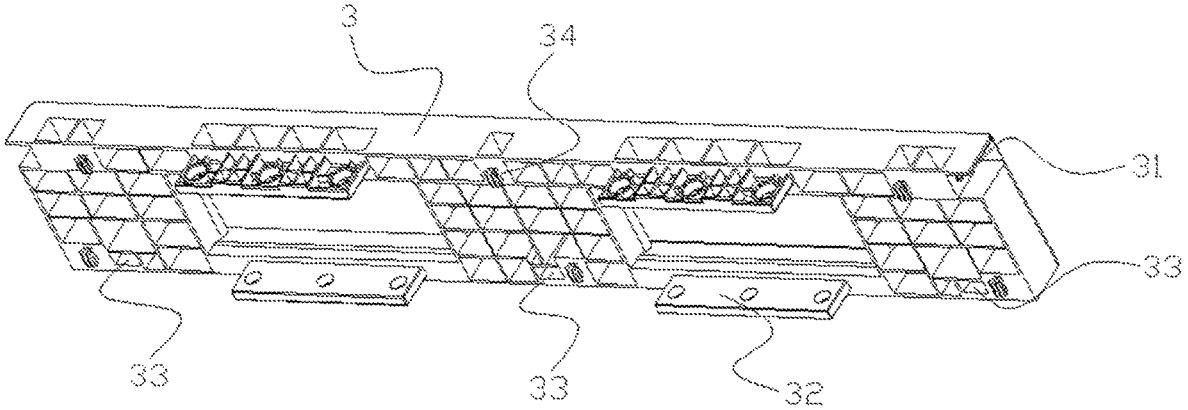
FIG. 15 is a diagram of a strake structure according to Embodiment 6-Embodiment 10 of the disclosure.
Figure 16:
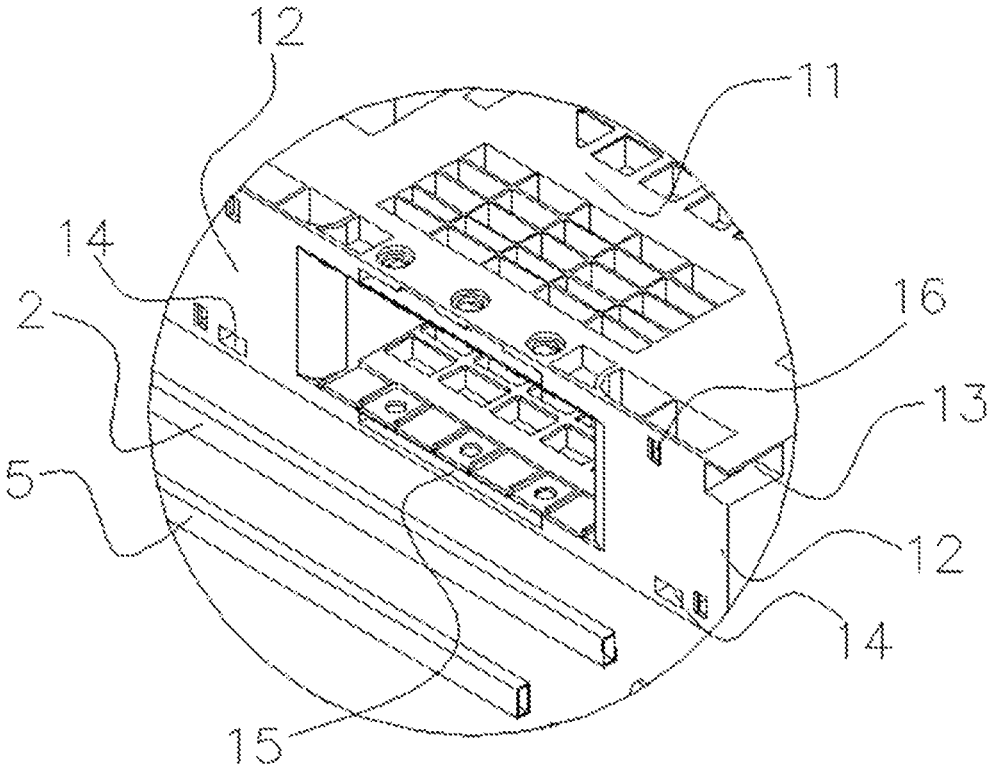
FIG. 16 is a partially enlarged diagram of a structure at position A of FIG. 1.

As shown in FIG. 15 and FIG. 16, this embodiment is based on Embodiment 1. The opposite two side surfaces of the strip-shaped pad foot 12 are also both provided positioning grooves 16, the positioning groove 16 and the second mainboard steel tube hole 14 are in the same plane, and the strake 3 is provided with a lug 34 matched with the positioning groove 16.

The strip-shaped pad foot 12 is provided with the positioning groove 16, and the strake 3 is provided with the lug 34 corresponding to the positioning groove 16, which is to facilitate positioning, and meanwhile lakes an effect of limiting the strake 3, so that connection between the strake 3 and the mainboard 1 is more stable.

Embodiment 9

Figure 10:
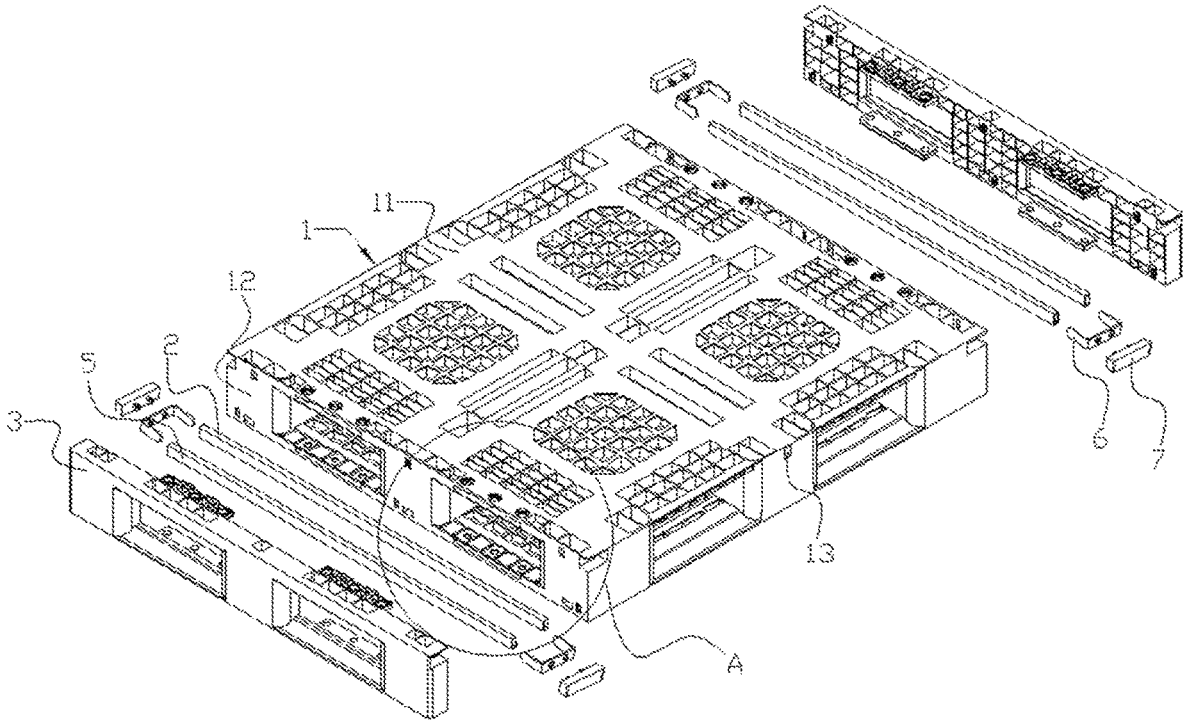
FIG. 10 is ail exposed structural view according to Embodiment 6-Embodiment 10 of the disclosure.
Figure 11:
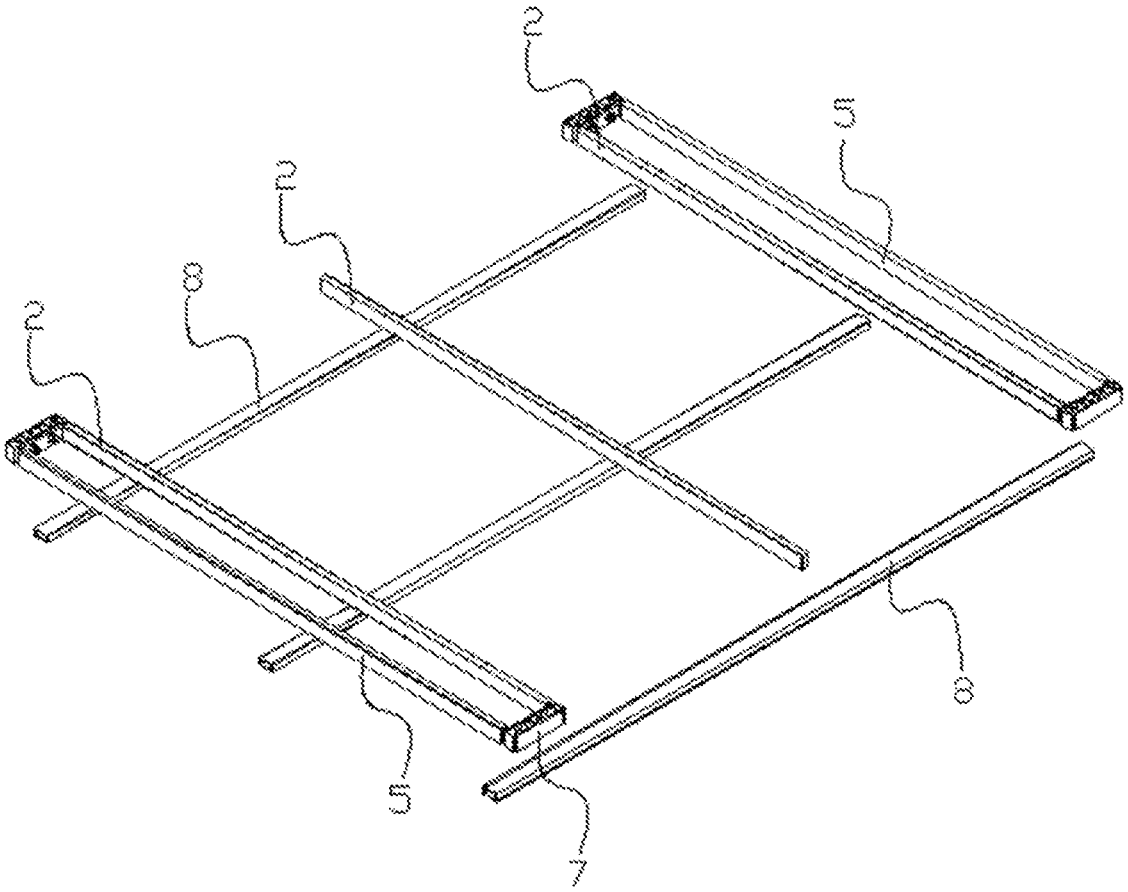
FIG. 11 is a structural diagram of steel tube distribution according to Embodiment 6-Embodiment 10 of the disclosure.
Figure 12:
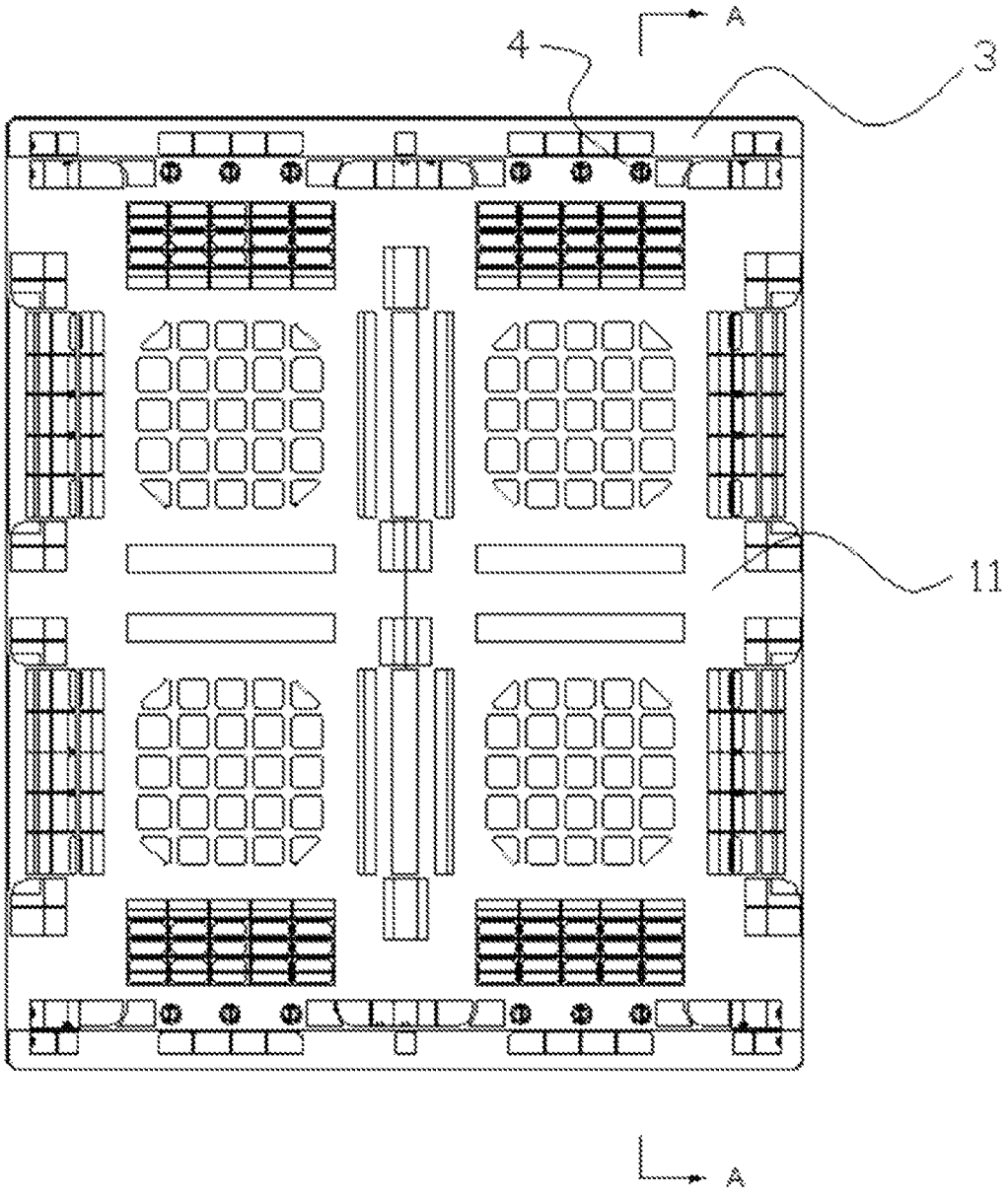
FIG. 12 is a top view of an overall structure according to embodiment 6-embodiment 10 of the disclosure.
Figure 13:
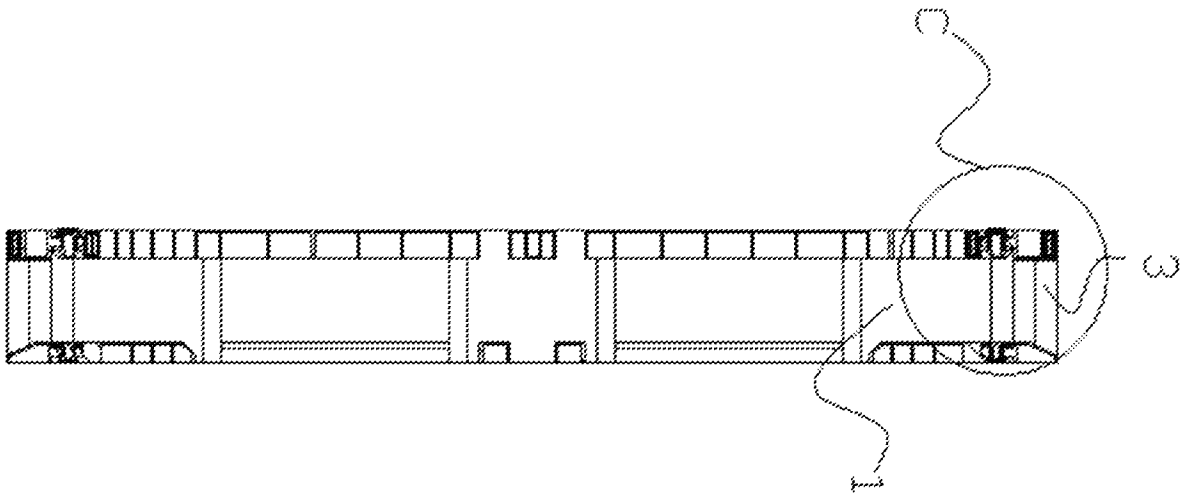
FIG. 13 is a cross-sectional view of an overall structure from a plan view taken along A-A according to Embodiment 6-Embodiment 10 of the disclosure.
Figure 14:
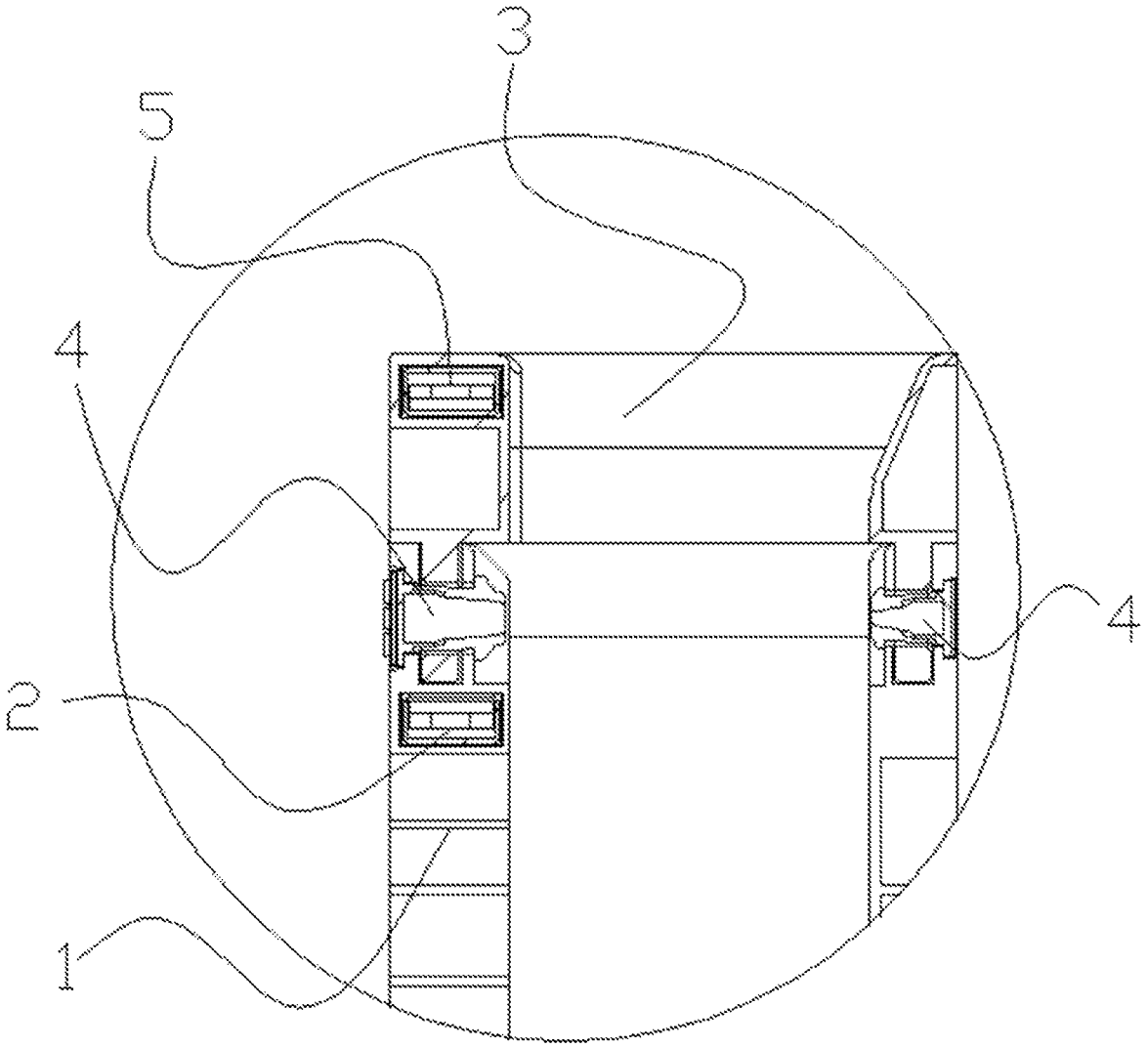
FIG. 14 is a partially enlarged diagram of a structure at position C of FIG. 13.
Figure 18:
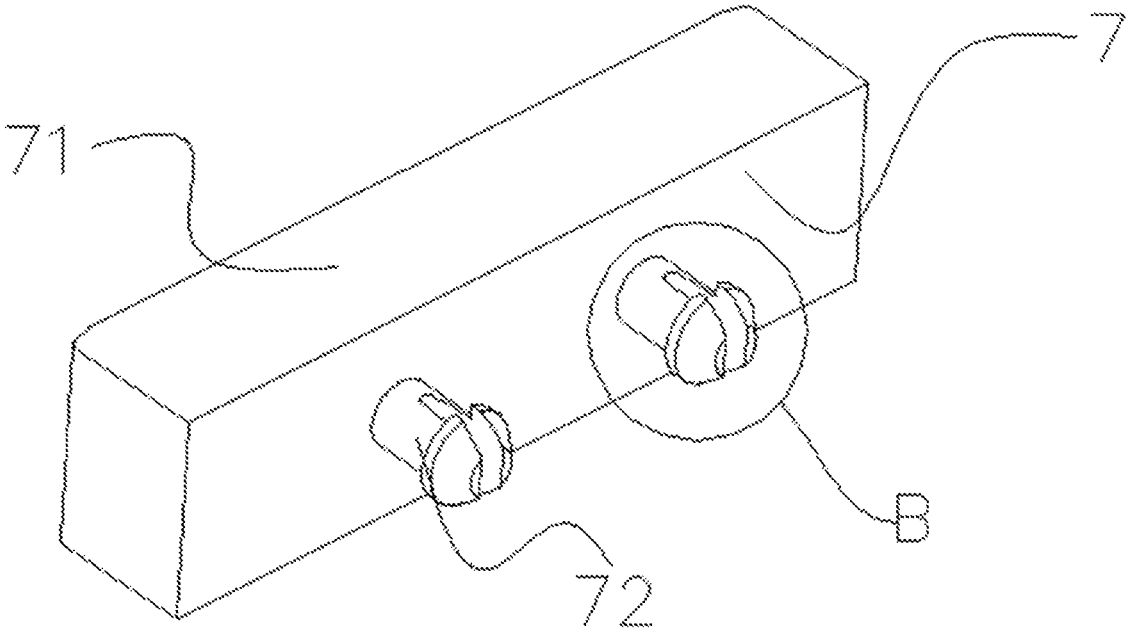
FIG. 18 is a diagram of an overall structure of a steel tube block according to Embodiment 6-Embodiment 10 of the disclosure.
Figure 19:
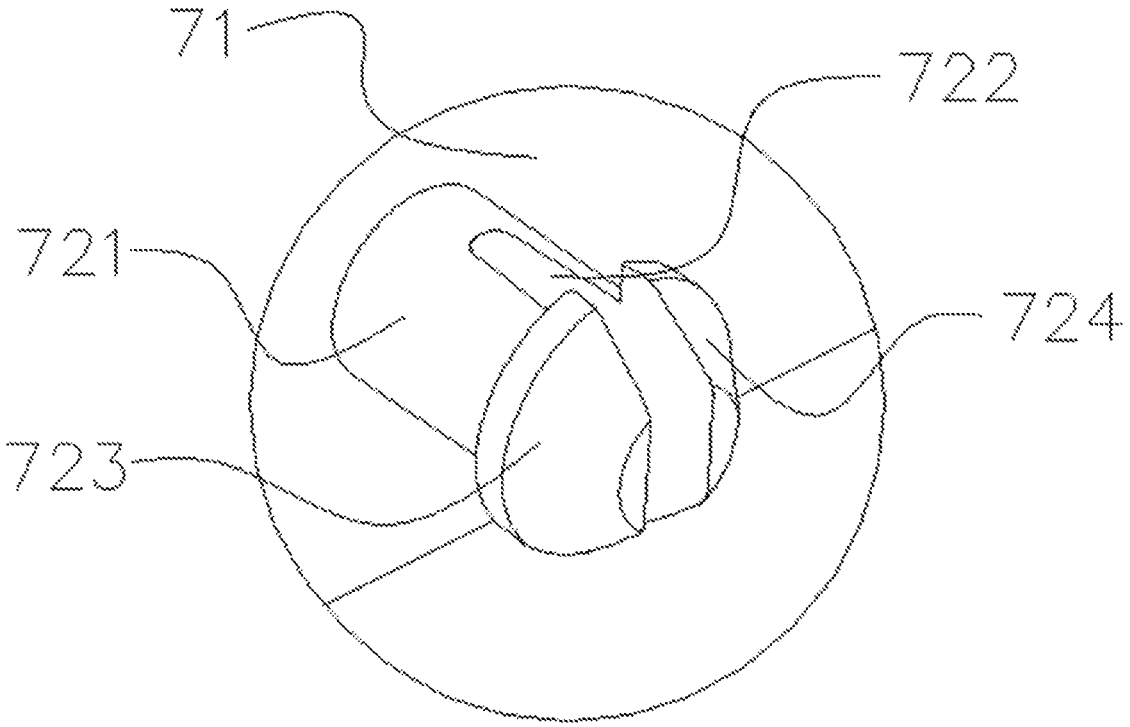
FIG. 19 is a partially enlarged view of a structure at position B of FIG. 9.
Figure 20:
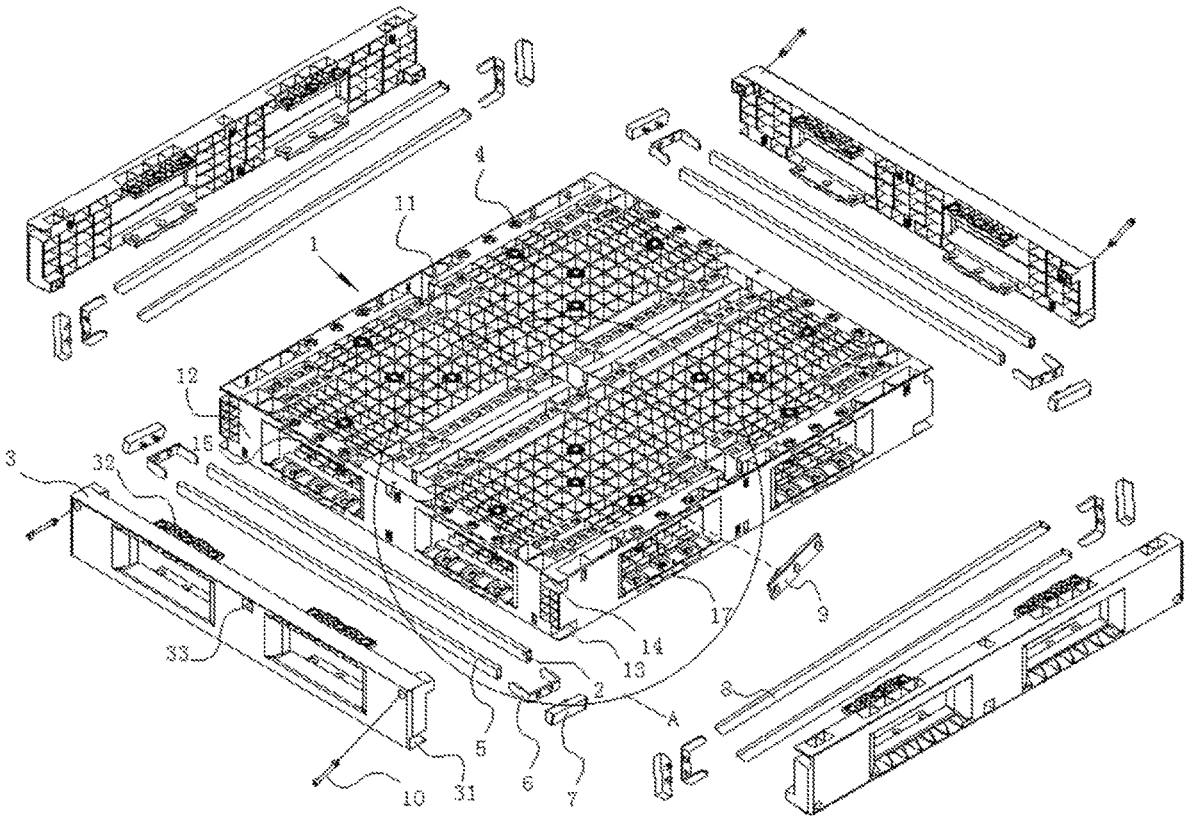
FIG. 20 is a splitting diagram of an overall structure according to Embodiment 11-Embodiment 15 of the disclosure.
Figure 21:
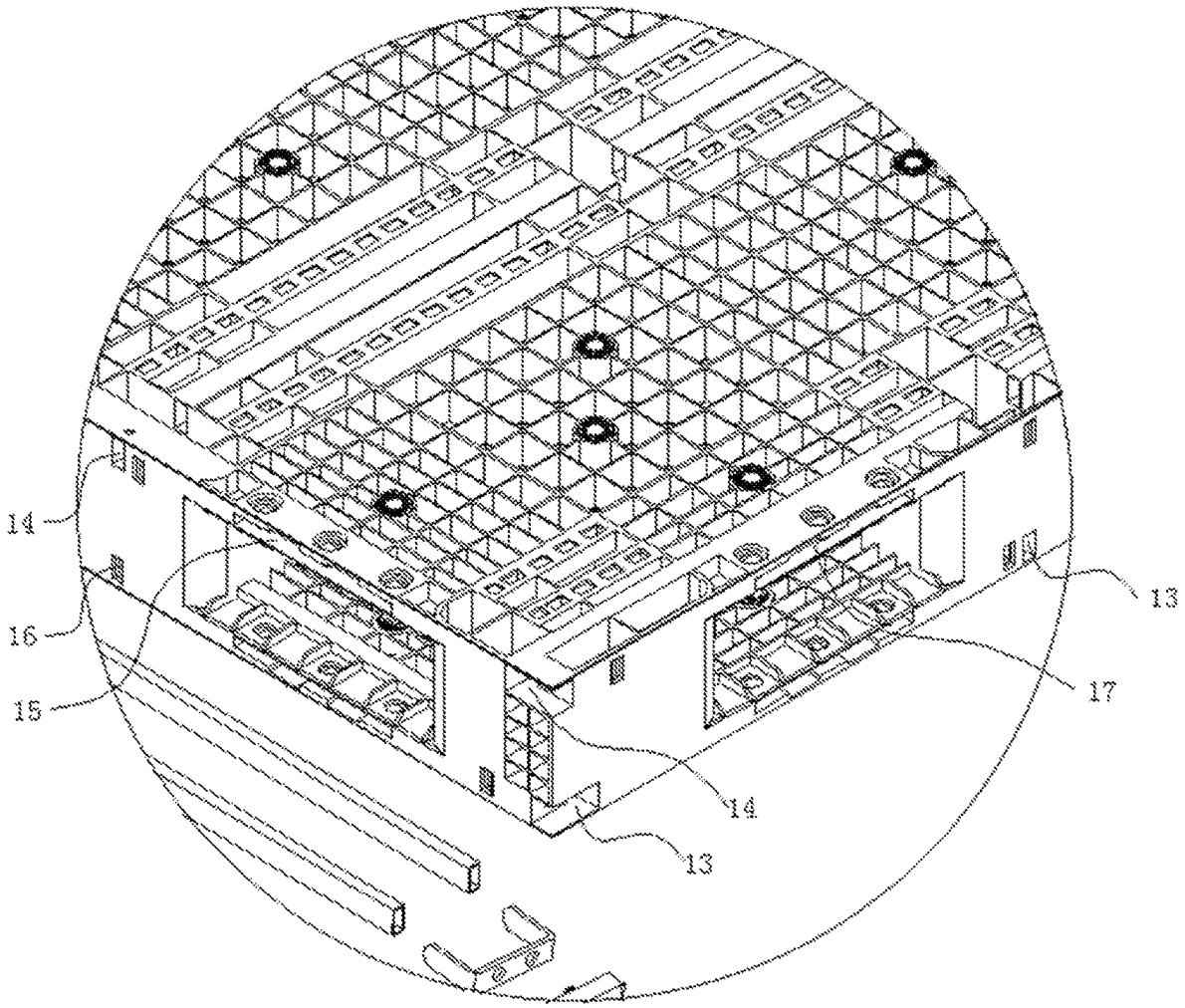
FIG. 21 is a partially enlarged view of a structure at position A of FIG. 20.

As shown in FIG. 10, FIG. 18 and FIG. 19, this embodiment is based on Embodiment 1. The steel tube connection member 6 is of a "concave" shape, and two sides of the steel tube connection member 6 are respectively connected with the strake steel tube 5 and the first mainboard steel tube 2 in an insertion manner, the steel tube block 7 includes a block body 71 and a plurality of block connection members 72 disposed on one side surface of the block body 71, the block connection member 72 includes a third elastic button 721 and a fourth elastic button 722 which are symmetrically disposed, and a third clamp convex and a fourth clamp convex are respectively formed in the outer sides of the third elastic button 721 and the fourth elastic button 722; the block connection member 72 penetrates through the bottom of the steel tube connection member 6 to be respectively connected with the strake 3 and the mainboard 1 in an insertion manner.

When in connection, two sides of the steel tube connection member 6 are respectively connected with the first mainboard steel tube 2 and the strake steel tube 5 in an insertion manner, the block connection member 72 disposed on the steel tube block 7 passes through the steel tube connection member 6 to be connected with the rib frame 11 and the strake 3, so that connection is convenient and the structure is firm when in use.

Embodiment 10

This embodiment is based on Embodiment 1. The materials of the mainboard 1, the widened strake 3 and the steel tube block 7 are all PP plastic or PE plastic, the material of the steel tube connection member 6 is iron; the mainboard steel tube and the strake steel tube 5 are both formed by cutting the profile steel tube.

The mainboard 1, the widened strake 3 and the steel tube block 7 all adopt PP plastic or PE plastic, which is because the PP plastic or PE plastic has the advantages of light weight, tasteless and no toxicity, acid alkali resistance and good chemical stability, the material of the stool tube connection member 6 is iron, which is because iron has high hardness and is not easy to deform; the mainboard stool tube and the shake steel tube 5 are both formed by cutting the profile steel tube, so cost is low, and processing is convenient.

Embodiment 11

A shown in FIGS. 20-29, a dual-face assembled plastic tray includes a mainboard 1 and strakes 3 fixed at two sides of the mainboard 1, the mainboard 1 includes rib frames 11 and a plurality of strip-shaped pad feet 12 uniformly distributed under the rib frames 11, and also includes first mainboard steel tubes 2, second mainboard steel tubes 8, strake steel tubes 5, steel tube connection members 6 and steel tube blocks 7;

The front and rear side surfaces of the rib frame 11 are provided with second mainboard steel tube holes 14 for mounting the second main steel tubes 8, the two ends and the middle portion of the rib frame 11 are at least provided with a second mainboard steel tube hole 14; the two ends of the second mainboard steel tube 8 located in the middle of the rib frame 11 extend out of the mainboard 1, and the strake 3 is provided with a placement groove 33 corresponding to the second mainboards steel tube 8; the front and rear side surfaces of the rib frame 11 are both provided with penetrating slots 15;

the strake 3, along the length direction, is provided with a strake steel tube hole 31 for mounting an strake steel tube 5, the strake steel tube hole 31 penetrates through the opposite side surfaces of the strake 3, the side surface of the strake 3 opposite to the rib frame 11 is provided with a boss 32 matched with the penetrating slot 15, and the boss 32 is inserted into the corresponding penetrating slot 15 to connect the mainboard 1 with the strake 3 through a strake connection block;

The left and right side surfaces and the middle portion of the rib frame 11 are provided with first mainboard steel tube holes 13 for mounting the first mainboard steel tubes 2, and the first mainboard steel tube hole 13 and the second mainboard steel tube hole 14 are vertical and respectively penetrate through the two rib frames 11; two ends of the first mainboard steel tube 2 located at the two ends of the rib frame 11 and the two ends and the middle portion of the rib frame 11 at least provided with one first mainboard steel tube hole 13, and the two ends of the first mainboard steel tube 2 located in the middle of the rib frame 1 extend out of the mainboard 1; the left and right side surfaces of the rib frame 11 are both provided with second penetrating slots 17, and the second penetrating slot 17 is internally provided with a bumper block 9 matched with the second penetrating slot 17;

the first mainboard steel tubes 2 located at the two ends of the rib frame 11 and the two ends of the strake steel tube 5 are both connected through the steel tube connection members 6, and the outer side of the steel tube connection member 6 is provided with a steel tube block 7 for connecting the steel tube connection member 6 with the rib frame 11 and the strake 3.

The steps for assembling the plastic tray comprise: firstly, respectively inserting first mainboard steel tubes 2 and second mainboard steel tubes 8 into first mainboard steel tube holes 13 and second mainboard steel tube holes 14 of the rib frames 11 on the mainboard 1, subsequently, mounting the two strakes 3 on the two side surfaces of the mainboard 1 through bosses 32 and penetrating slots 15 and fixing the bosses 32 and the penetrating slots 15 through strake connection blocks 4, then inserting strake steel tubes 5 into strake steel tube holes 31 on the two strakes 3, fixing the strake steel tubes 5 and the first mainboard steel tubes 2 through the steel tube connection members 6 and steel blocks 7, and finally, mounting top and bottom non-slip mats on the rib frame 11, wherein, the non-slip mats are mounted on the two rib frames 11 and extend out of the surfaces of the upper and lower rib fames 11 to take an antiskid effect, and the strake 3 and the rib frame 11 are fixed in a clamp manner, fixation is more firm through double fixation, and change of the strake 3 is convenient and meanwhile cost is saved; the injection molding process of the mainboard 1 and the strake 3 comprise the following steps: (1) loading, namely, mixing selected materials in a proportion and putting the mixture into an injection molding machine; (2) drying the materials, namely, evaporating the moisture contained in the materials; (3) checking and testing a device, namely, detecting if there is any abnormality in the device; (4) changing a mould, namely, changing the corresponding mould to prepare for injection molding; (5) performing screw heating to melt the materials in the injection molding machine; (6) closing the mould, namely, closing upper and lower moulds; (7) performing injection molding, namely, inject melted materials into the moulds; (8) opening the moulds, namely, opening the moulds after the products subjected to injection molding are cooled; (9) finishing, namely, taking out the cooled products and finishing to remove burr edges; (10) performing quality inspection, namely, performing quality inspection on the corresponding products, to remove defective products; and (11) packaging, namely, independently packaging individual products, and after that, binning and pasting qualified certifications.

Figure 30:
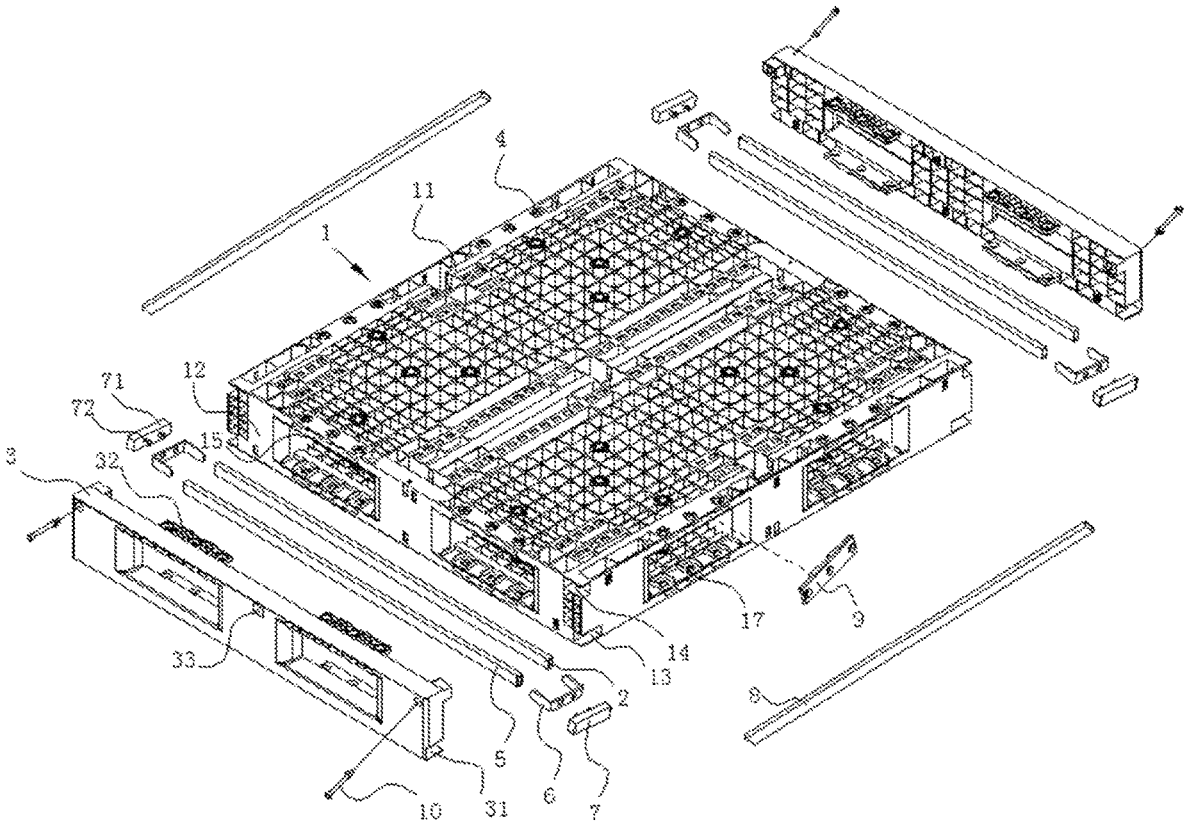
FIG. 30 is a structural diagram of front and rear mounting strakes of a mainboard according to Embodiment 11-Embodiment 15 of the disclosure.
Figure 31:
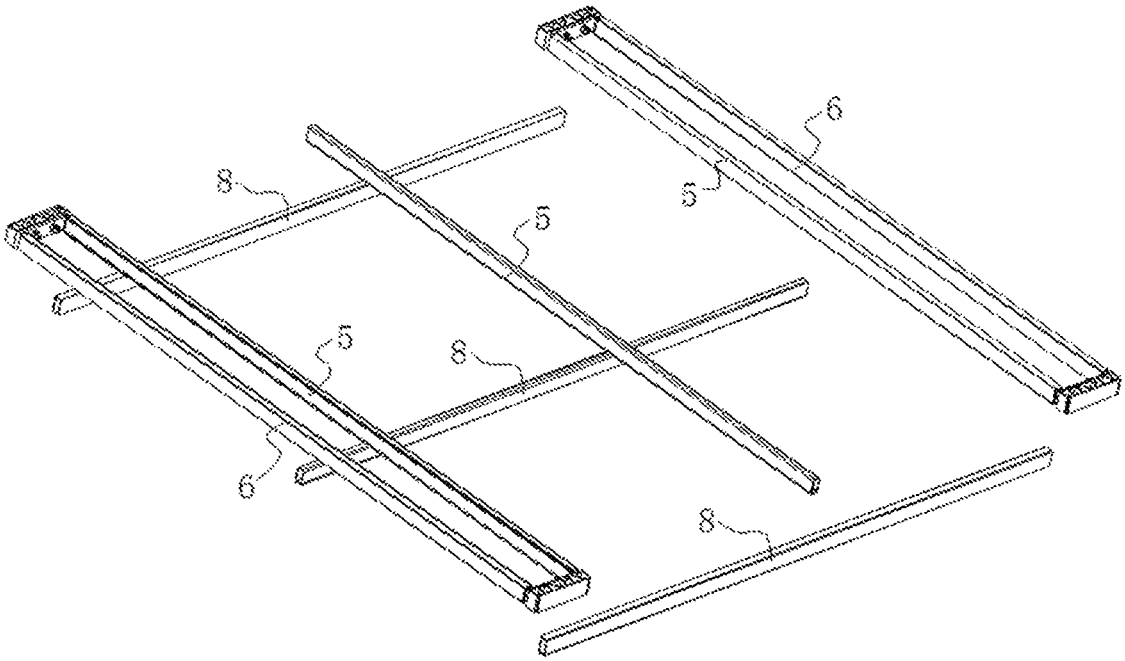
FIG. 31 is a diagram of steel tube installation of FIG. 30.
Figure 32:
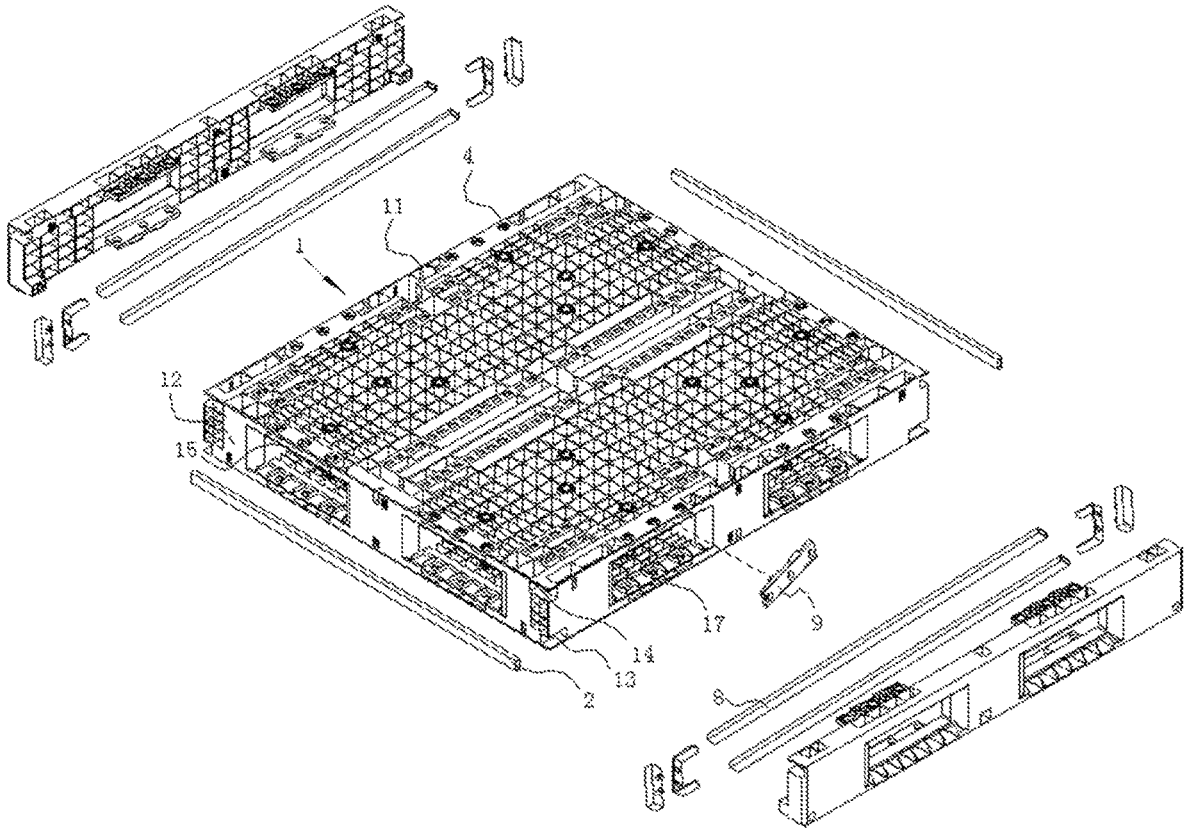
FIG. 32 is a structural diagram of left and right mounting strakes of a mainboard according to Embodiment 11-Embodiment 15 of the disclosure.
Figure 33:
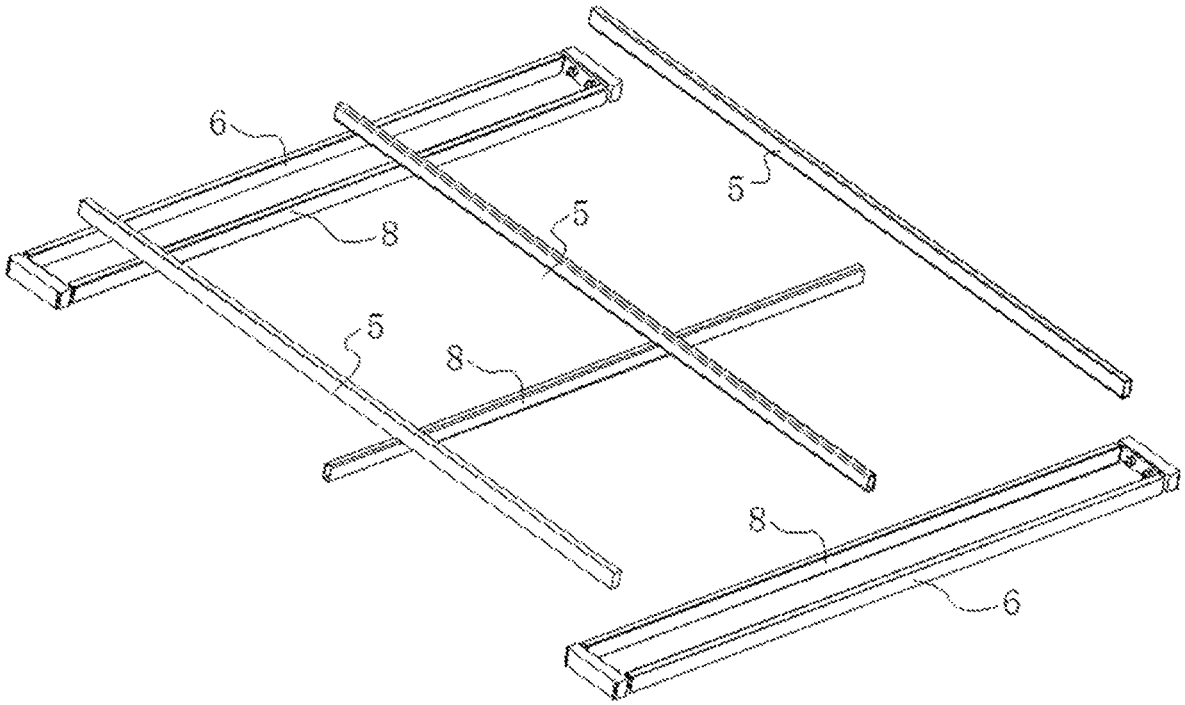
FIG. 33 is a diagram of steel tube installation of FIG. 32.

Meanwhile, when the strakes 3 are mounted in this mainboard 1, left and right strakes 3 or front and rear strakes 3 can only be mounted, the strakes 3 cannot be mounted from four surfaces. As shown in FIGS. 30-31, the strakes 3 are mounted in the front and rear of the mainboard 1. As shown in FIGS. 32-33, the strakes 3 are mounted in the left and right of the mainboard 1.

Embodiment 12

Figure 23:
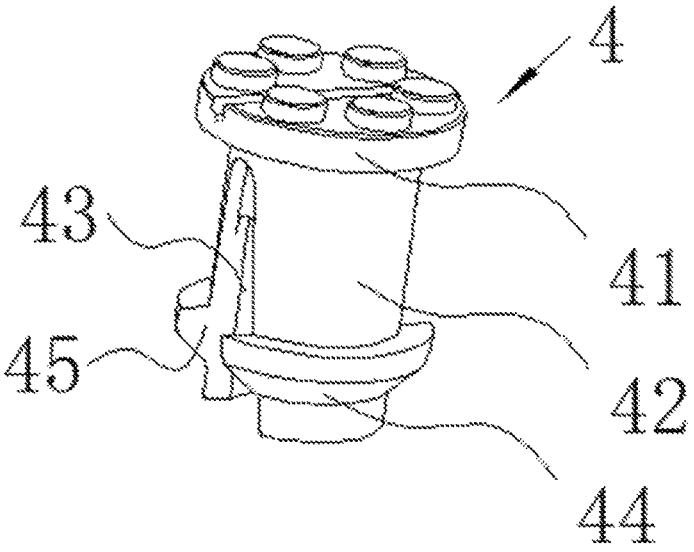
FIG. 23 is a structural diagram of a strake connection block of FIG. 20.

As shown in FIG. 23, this embodiment is modified on the basis of Embodiment 1. The strake connection block 4 includes a clamp portion 41 as well as a first elastic button 42 and a second clamp portion symmetrically formed at the lower end of the clamp portion 41, and a first clamp convex 44 and a second clamp convex 45 are respectively formed in the outer sides of the first elastic button 42 and the second elastic button 43. The strake connection block 4 includes a clamp portion 41 as well as a first elastic button 42 and a second clamp portion symmetrically formed at the lower end of the clamp portion 41, which is to facilitate installation, and when this strake connection block 4 connects the strake 3 with the rib frame 11, the strake 3 and the rib frame 11 are tightly clamped through the first clamp convex 44 and the second clamp convex 45 so that the structures are more stable.

Embodiment 13

Figure 22:
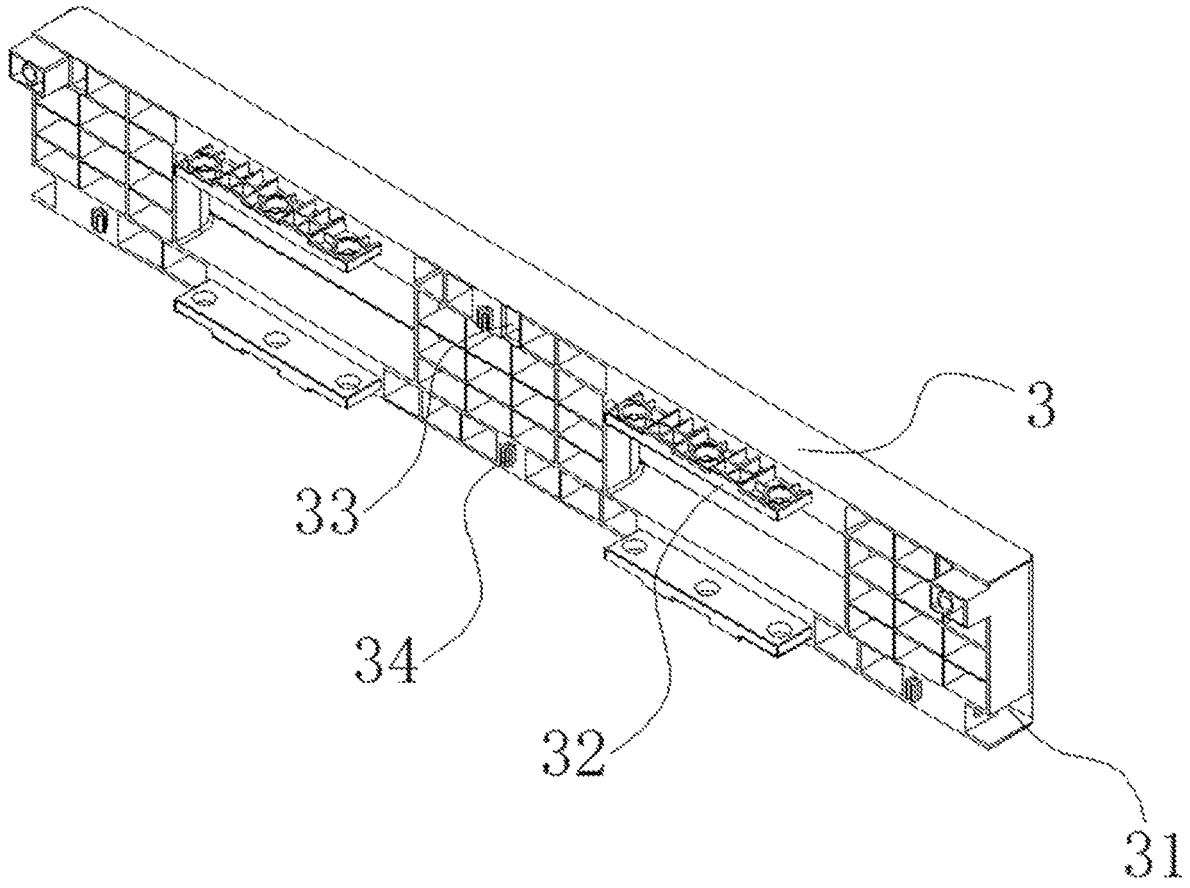
FIG. 22 is a structural diagram of a strake of FIG. 20.

As shown in FIG. 22, this embodiment is modified on the basis of Embodiment 1. The two side surfaces of the mainboard 1 relative to the strakes 3 are both provided with positioning grooves 16, and the strake 3 is provided with a lug 34 corresponding to the positioning groove 16. The strip-shaped pad foot 12 is provided with the positioning groove 16, and the strake 3 is provided with a lug 34 corresponding to the positioning groove 16, which is to facilitate positioning and meanwhile takes an effect of limiting the strake 3 so that connection between the strake 3 and the mainboard 1 is more stable.

Embodiment 14

Figure 24:
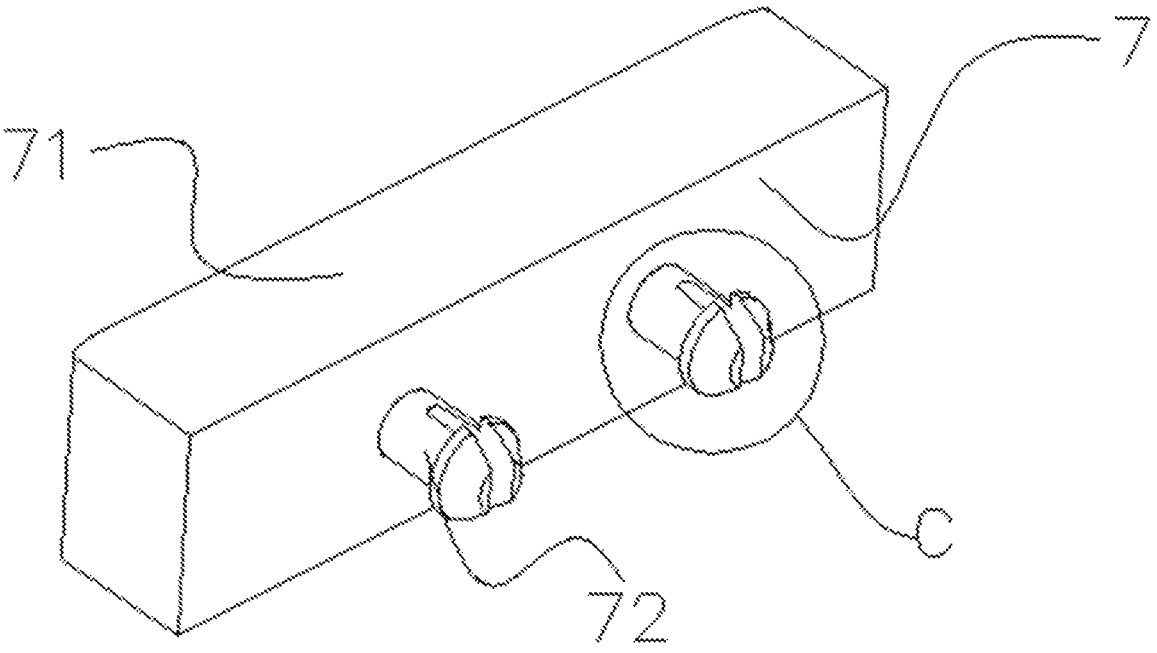
FIG. 24 is a structural diagram of a steel tube block of FIG. 20.
Figure 25:
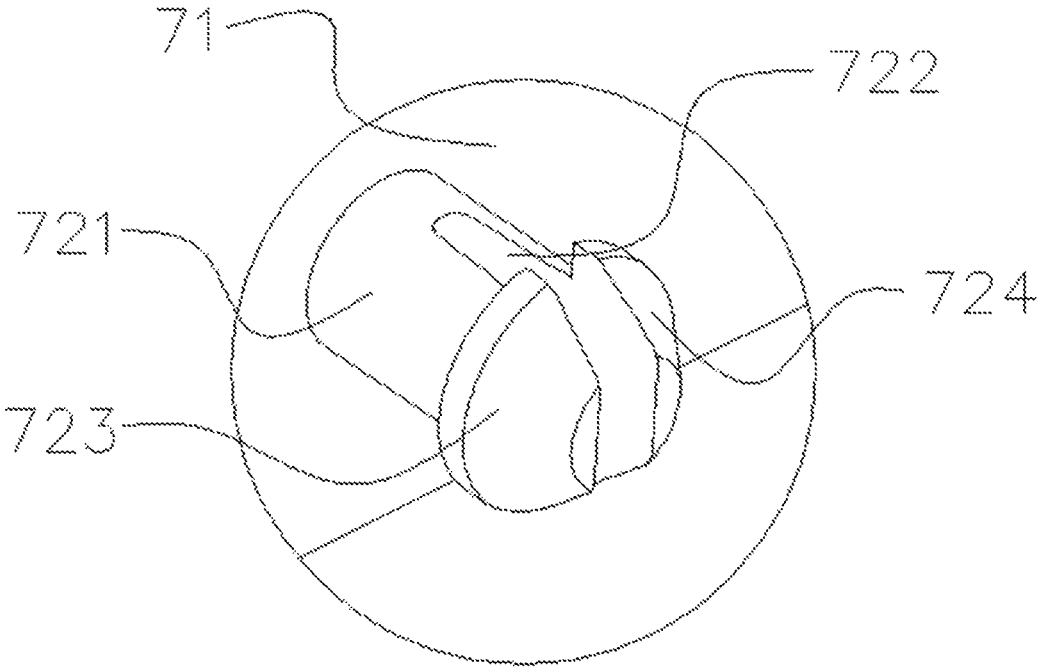
FIG. 25 is a partially enlarged view of a structure at position C of FIG. 24.
Figure 26:
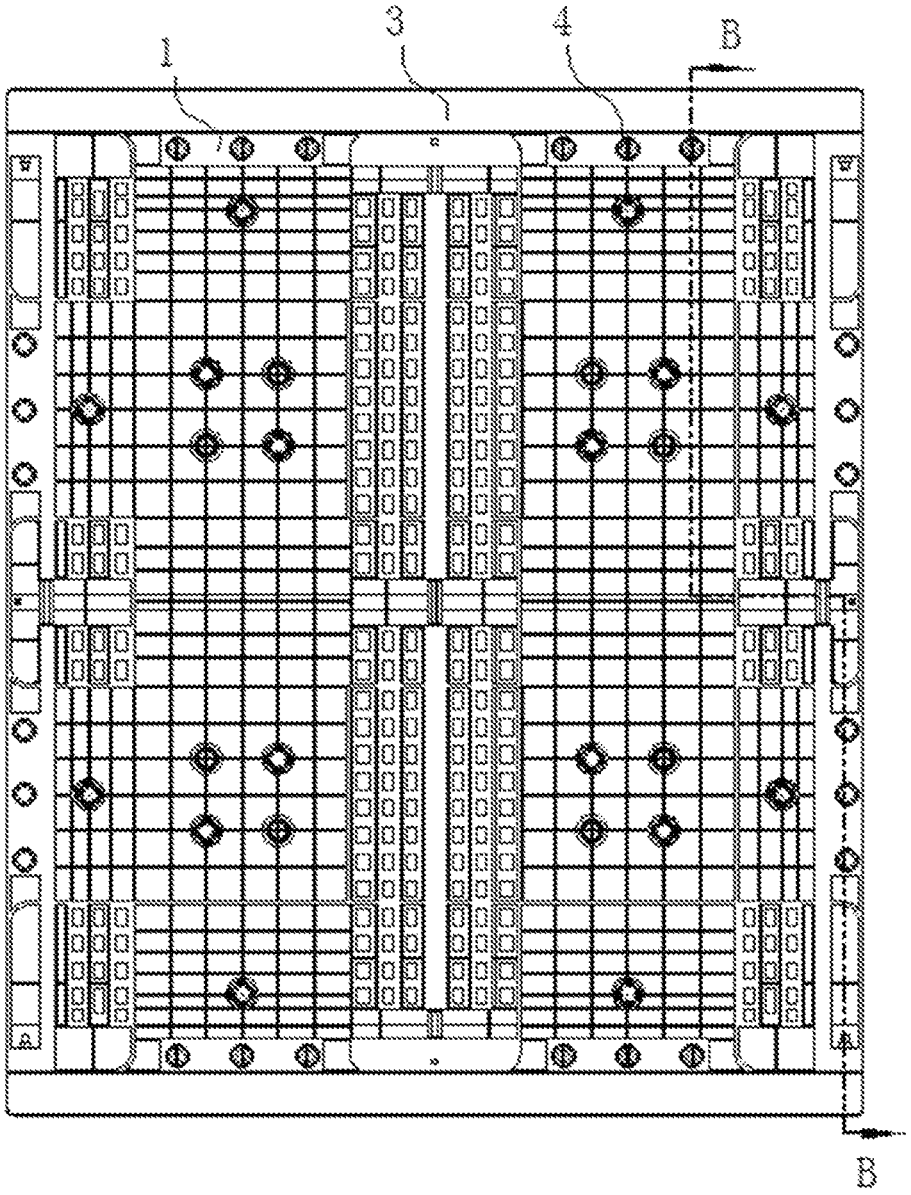
FIG. 26 is a top view of FIG. 20.
Figure 27:
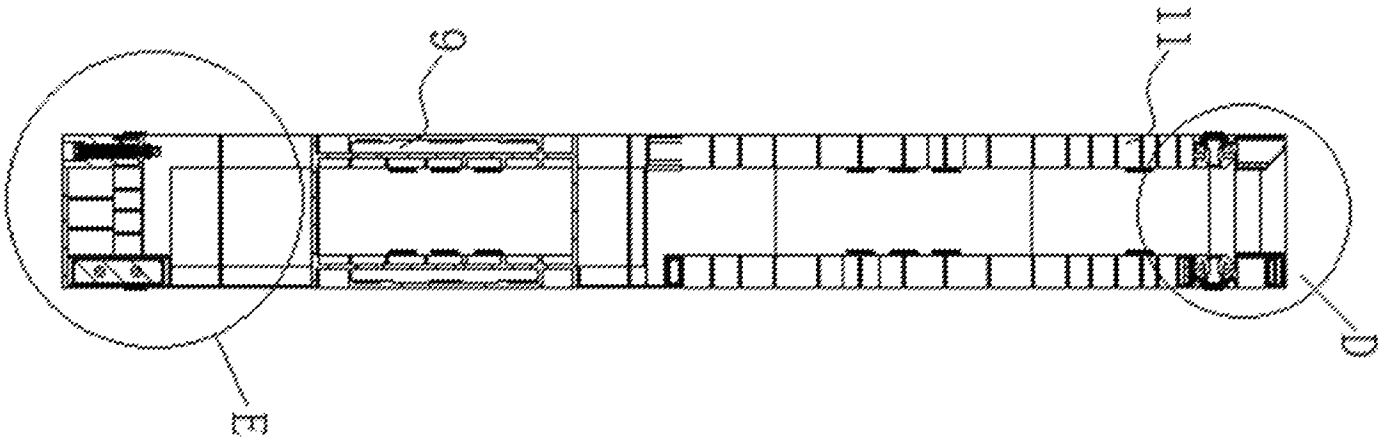
FIG. 27 is a cross-sectional view taken along B-B of FIG. 26.
Figure 28:
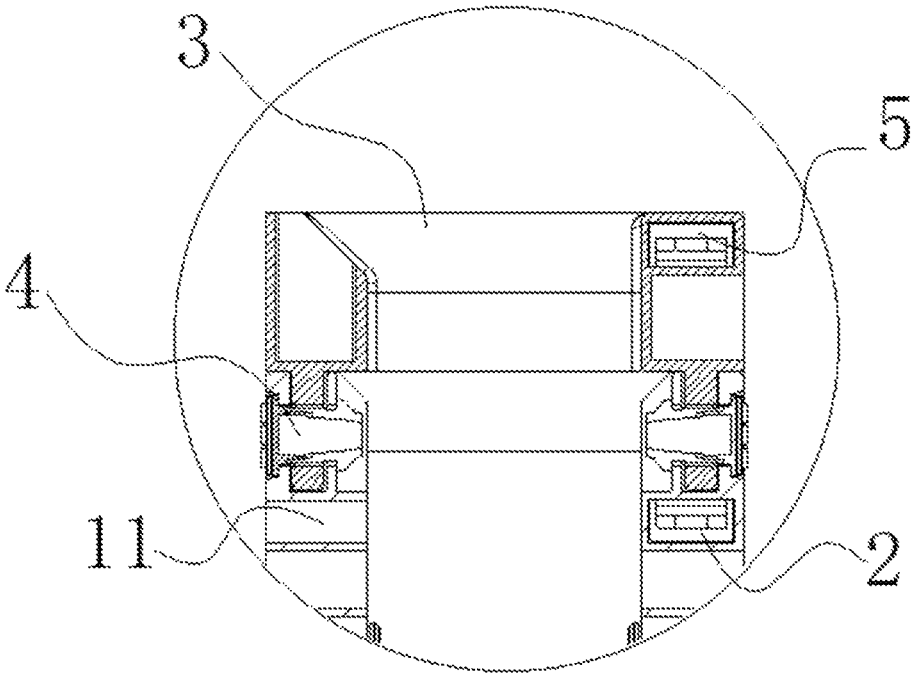
FIG. 28 is a partially enlarged view of a structure at position D of FIG. 27.
Figure 29:
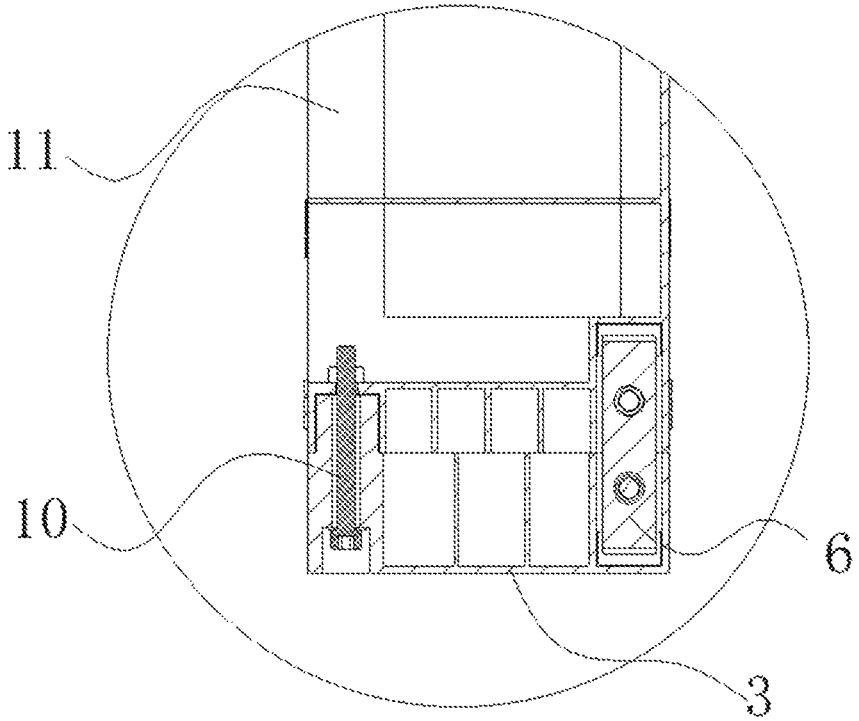
FIG. 29 is a partially enlarged view of a structure at position E of FIG. 27

As shown in FIGS. 24-26, this embodiment is modified on the basis of Embodiment 1. The cross section of the stool tube connection member 6 is of a "concave" shape, and two sides of the connection member are respectively connected with the strake steel tube 5 and the first mainboard stool tube 2 in an insertion manner; the steel tube block 7 includes a block body 71 and a plurality of block connection members 72 disposed on one side surface of the block body 71, the block connection member 72 includes a third elastic button 721 and a fourth elastic button 722 which are symmetrically disposed, and a third clamp convex and a fourth clamp convex are respectively formed in the oilier sides of the third elastic button 721 and the fourth elastic button 722; the block connection member 72 penetrates through the bottom of the steel tube connection member 6 to be respectively connected with the strake 3 and the mainboard 1 in an insertion manner The "concave"-shaped steel tube connection member 6 is correspondingly inserted into the first mainboard steel tube 2 and the strake steel tube 5, the steel tube connection member 6 is connected with the mainboard 1 and the strake 3 through the steel tube block 7, which is to facilitate change of the strake 3. Here, a clamp manner is adopted for fixation in order to facilitate change of the strake 3.

Embodiment 15

This embodiment is modified on the basis of Embodiment 1. The outer side of the strake 3 is provided with a connection bolt 10 which penetrates through the outer wall of the strake 3 to be connected with the mainboard 1. The strake 3 is connected with the mainboard 1 through the connection bolt 10, which improves the connection reliability of the strake 3.

The above embodiments are only embodiments of the disclosure, and their descriptions are specific and detailed, but cannot thereby be understood as limiting the scope of the present invention patent. It should be noted that those skilled in the art can also make several deformations and improvements without departing from the concept of the disclosure, and these deformations and improvements are all included in the protection scope of the disclosure.

I claim:

1. An assembled plastic tray, comprising a mainboard and at least one strake fixed at two sides of the mainboard; the mainboard comprises at least one rib frame, a plurality of strip-shaped pads disposed on a lower end of the rib, at least one first mainboard steel tube, at least one second mainboard steel tube, at least one strake steel tube, at least one steel tube connection member and at least one steel tube block;

wherein each one of the strip-shaped pads is provided with at least one second mainboard steel tube hole for mounting the second mainboard steel tube; both ends of the second mainboard steel tube extend out of the second mainboard steel tube hole; each of the strake is provided with a placement groove corresponding to the second mainboard steel tube hole on the strip-shaped pad; the second mainboard steel tube hole is arranged far away from the rib frame; and at least one penetrating slot is provided on one opposite side surfaces of the rib frame;

at least one first mainboard steel tube hole for mounting the first mainboard steel tube is provided at both end and middle portions of the other opposite side surfaces of the rib frame, and the first mainboard steel tube hole is perpendicular to the second mainboard steel tube hole and penetrates through the rib frame;

the strake, along a length direction, is provided with at least one strake steel tube hole for mounting the strake steel tube; the strake steel tube hole penetrates through one opposite side surfaces of the strake, the side surface of the strake opposite to the rib frame is provided with a boss matching with the penetrating slot, and the boss is inserted into the corresponding penetrating slot to connect the mainboard with the strake through a strake connection block;

both ends of the first mainboard steel tube and both ends of the strake steel tube are connected through the steel tube connection member, and an outer side of the steel tube connection member is provided with a steel tube block for connecting the steel tube connection member with the mainboard and the strake.

2. The assembled plastic tray of claim 1, wherein the number of the rib frames is 2, and the plurality of strip-shaped pads are disposed between the two rib frames.

3. The assembled plastic tray of claim 2, wherein the first mainboard steel tube hole is provided with at least one second penetrating slot, the second penetrating slot is internally provided with a bumper block having a shape matched with the shape of the second penetrating slot; and the second penetrating slot is connected with the bumper block through the strake connection block.

4. The assembled plastic tray of claim 3, wherein an outer side of the strake is also provided with a connection bolt, and the connection bolt passes through the outer wall of the strake to be connected with the mainboard.

5. The assembled plastic tray of claim 1, wherein the strake connection block comprises a clamp portion as well as a first elastic button and a second elastic button symmetrically formed at a lower end of the clamp portion; and a first clamp convex and a second clamp convex are respectively formed in the outer sides of the first elastic button and the second elastic button.

6. The assembled plastic tray of claim 1, wherein both side surfaces of the mainboard opposite to the strake are provided with at least one positioning groove; and the strake is provided with at least one lug matching with the positioning groove.

7. The assembled plastic tray of claim 1, wherein a cross section of the steel tube connection member is of a "concave" shape, and the both ends of the steel tube connection member are respectively connected with the strake steel tube and the first mainboard steel tube in an insertion manner; the steel tube block further comprises a block body and a plurality of block connection members disposed on one side surface of the block body; each one of the block connection members comprises a third elastic button and a fourth elastic button arranged symmetrically; a third clamp convex and a fourth clamp convex are respectively formed on outer sides of the third elastic button and the fourth elastic button; each one of the block connection members passes through a the bottom of the steel tube connection member to be respectively connected with the strake and the mainboard in an insertion manner.

8. The assembled plastic tray of claim 1, wherein a material of the mainboard and the strake are both PP plastic or PE plastic.

* * * * *